US011808065B2

(12) United States Patent
Lee

(10) Patent No.: US 11,808,065 B2
(45) **Date of Patent: *Nov. 7, 2023**

(54) SLIDING/SWING COMPOSITE DOOR FOR VEHICLE

(71) Applicants: Hyundai Motor Company, Seoul (KR); Kia Motors Corporation, Seoul (KR)

(72) Inventor: Jae Seung Lee, Hwaseong-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 385 days.

This patent is subject to a terminal disclaimer.

(21) Appl. No.: 17/080,041

(22) Filed: Oct. 26, 2020

(65) Prior Publication Data

US 2021/0140206 A1 May 13, 2021

(30) Foreign Application Priority Data

Nov. 7, 2019 (KR) ..... 10-2019-0141521
Nov. 7, 2019 (KR) ..... 10-2019-0141523

(51) Int. Cl.
*E05F 15/00* (2015.01)
*E05B 85/16* (2014.01)
(Continued)

(52) U.S. Cl.
CPC ..... *E05B 85/16* (2013.01); *E05B 79/12* (2013.01); *E05B 83/40* (2013.01); *E05B 85/04* (2013.01);
(Continued)

(58) Field of Classification Search
CPC ..... E05B 85/16; E05B 85/04; E05B 85/22; E05B 85/24; E05B 79/12; E05B 79/20; E05B 79/22; E05B 83/40; E05B 83/38; E05B 83/36; E05D 15/58; E05Y 2201/11; E05Y 2201/22; E05Y 2201/68; E05Y 2201/684; E05Y 2201/686; E05Y 2201/688; B60J 2900/531; B60J 5/047; B60J 5/06
(Continued)

(56) References Cited

U.S. PATENT DOCUMENTS 6,955,389 B2 * 10/2005 Suzuki ..... E05B 65/0811 292/201
7,168,753 B1 * 1/2007 Faubert ..... B60J 5/047 296/146.12
(Continued)

FOREIGN PATENT DOCUMENTS

DE 102020213805 A1 * 5/2021 ..... E05B 79/12
EP 2792519 A2 * 10/2014 ..... B60J 5/047
KR 101786663 B1 10/2017

*Primary Examiner* — Jerry E Redman
(74) *Attorney, Agent, or Firm* — Slater Matsil, LLP

(57) ABSTRACT

A sliding/swing composite door for a vehicle includes a sliding door, an outside handle located on an outer surface of the sliding door, wherein the sliding door is configured to be opened upon a first operation of the outside handle, and a swing door configured to be opened integrally with the sliding door upon a second operation of the outside handle, wherein the swing door is configured to be rotated and opened in a state where the sliding door is fully opened.

20 Claims, 18 Drawing Sheets

(51) Int. Cl.
*E05B 85/04* (2014.01)
*E05B 83/40* (2014.01)
*E05B 79/12* (2014.01)
*E05D 15/58* (2006.01)

(52) U.S. Cl.
CPC ..... *E05D 15/58* (2013.01); *E05Y 2201/11* (2013.01); *E05Y 2201/22* (2013.01); *E05Y 2201/68* (2013.01); *E05Y 2201/684* (2013.01); *E05Y 2201/686* (2013.01); *E05Y 2201/688* (2013.01); *E05Y 2900/531* (2013.01)

(58) Field of Classification Search
USPC ..... 49/360
See application file for complete search history.

(56) References Cited

U.S. PATENT DOCUMENTS 7,815,229 B2 * 10/2010 Ooe ..... E05B 83/40 292/216
8,616,594 B2 * 12/2013 Shimura ..... E05B 79/20 292/201
8,646,208 B2 * 2/2014 Taracko ..... B60J 5/047 49/155
9,004,552 B2 * 4/2015 Sonnek ..... E05F 15/70 292/336.3
9,016,762 B2 * 4/2015 Ojima ..... B60J 5/047 701/49
9,073,413 B2 * 7/2015 Maruyama ..... B60J 5/047
9,731,583 B2 * 8/2017 Maruyama ..... B60J 5/047
10,024,084 B2 7/2018 Choi
10,369,870 B2 * 8/2019 Linden ..... E05F 17/004
10,384,519 B1 * 8/2019 Brown ..... B60J 5/047
10,518,616 B2 * 12/2019 Houmani ..... E05D 15/48
11,472,271 B2 * 10/2022 Choi ..... B60J 5/06
11,607,935 B2 * 3/2023 Lee ..... B60J 5/105
11,629,539 B2 * 4/2023 Choi ..... E05B 83/40 49/164
11,643,860 B2 * 5/2023 Choi ..... E05F 15/638 49/362
2003/0218358 A1 * 11/2003 Hahn ..... B60J 5/047 296/155
2006/0197357 A1 * 9/2006 Catania ..... E05D 15/58 296/155
2013/0227887 A1 * 9/2013 Ojima ..... B60J 5/047 49/143
2014/0075843 A1 * 3/2014 Maruyama ..... E06B 3/5072 49/404
2016/0272054 A1 * 9/2016 Maruyama ..... B60J 5/06
2016/0273262 A1 * 9/2016 Maruyama ..... E05B 79/10
2021/0140215 A1 * 5/2021 Choi ..... B60J 5/047
2021/0170842 A1 * 6/2021 Choi ..... E05D 15/1047
2021/0172228 A1 * 6/2021 Choi ..... E05D 15/48
2021/0172236 A1 * 6/2021 Choi ..... E05D 15/48
2021/0172237 A1 * 6/2021 Choi ..... E05F 15/655
2022/0090421 A1 * 3/2022 Choi ..... B60J 5/047
2022/0090427 A1 * 3/2022 Choi ..... E05D 15/48

* cited by examiner

SLIDING/SWING COMPOSITE DOOR FOR VEHICLE

CROSS-REFERENCE TO RELATED APPLICATIONS

This application claims the benefit of Korean Application No. 10-2019-0141521, filed on Nov. 7, 2019, and Korean Application No. 10-2019-0141523, filed on Nov. 7, 2019, which applications are hereby incorporated herein by reference.

TECHNICAL FIELD

The present disclosure relates to a sliding/swing composite door for a vehicle.

BACKGROUND

A door for a vehicle uses various types, but among them, there may be, for example, a swing type mainly applied to a passenger car, a sliding type mainly applied to a medium-sized van, and a hatch back type mainly applied to the tail gates of a van and an RV vehicle. Generally, a vehicle provided with a sliding door has a structure of sliding a door as close to a vehicle body as possible to be opened, thereby improving the convenience of boarding and getting on and off in a narrow space.

In the case of the van in which many people may ride, a vehicle compartment is opened or closed while a vehicle compartment opening/closing door performs a sliding motion in the front-rear direction in the longitudinal direction of a vehicle. The vehicle compartment opening/closing door using the sliding method of the van moves in the rear direction in the longitudinal direction of the vehicle to open the vehicle compartment whereas moving forward in the longitudinal direction of the vehicle to close the vehicle compartment, such that there are advantages in that the vehicle compartment opening/closing door may have a smaller opening/closing necessity space necessary for opening or closing the door than that of a hinge-type vehicle compartment opening/closing door of the passenger car, and fully open a door opening formed in the vehicle body even in a narrow opening/closing necessity space.

However, there is a problem in that due to the limitation of configuration of opening or closing the door in the sliding method, there is the restraint to the opening width compared to the door of the swing method even in the case of being fully slid and opened.

Meanwhile, the swing door has an advantage in that the opening width of the vehicle may be maximized when being fully opened whereas if the periphery of the swing door is close to a structure, the swing door may not be fully opened when the door is in contact with the structure, such that there may be a spatial restraint when a person is on board or loads and unloads the luggage.

To open or close the door for the vehicle, an outside handle is exposed to the outside of a door panel, and a door latch assembly locked or unlocked by a means such as a remote controller or a key is mounted inside the door panel. Therefore, when a user is normally intended to open the door outside the vehicle, a solenoid of the door latch assembly receiving a signal of the remote controller is operated in an opening direction of the door to unlock the door latch when the user operates an opening button of the remote controller or the like, and subsequently, the user pulls the outside handle of the door in the opening direction to open the door.

The above information disclosed in this Background section is only for enhancement of understanding of the background of the disclosure and accordingly it may contain information that does not form the prior art that is already known in this country to a person of ordinary skill in the art.

Korean Patent No. 10-1786663 is related to the subject matter of this application.

SUMMARY

The present disclosure is intended to solve problems in the related art.

The present disclosure relates to a sliding/swing composite door for a vehicle. Particular embodiments relate to a composite door combining the respective advantages by coupling a sliding method and a swing method to a door system for a vehicle.

Further, embodiments of the present disclosure provide a sliding/swing composite door for a vehicle, which may open or close a door in a sliding method and a swing method by changing an operation method of a single outside handle.

Features of the present disclosure are not limited to the aforementioned features, and other features of the present disclosure which are not mentioned may be understood by the following description, and may be more clearly understood by exemplar embodiments of the present disclosure. Further, features of the present disclosure may be realized by the means indicated in the claims and combinations thereof.

A sliding/swing composite door for a vehicle includes the following configuration.

An exemplary embodiment of the present disclosure provides a sliding/swing composite door for a vehicle which includes an outside handle located on the outer surface of a sliding door, the sliding door opened upon a first operation of the outside handle, and a swing door opened integrally with the sliding door upon a second operation of the outside handle, in which the swing door is rotated and opened in a state where the sliding door is fully opened.

Further, the outside handle includes a body portion; and a handle cover portion, and the body portion is configured to include a sliding body movable integrally with the handle cover portion in the sliding direction upon the first operation, and a swing body which may be pulled integrally with the handle cover portion upon the second operation.

Further, the sliding/swing composite door for a vehicle further includes a sliding striker mounted on the inner surface of a vehicle body, a sliding latch part configured to be located on the inner surface of the sliding door, and to be fastened to or released from the sliding striker, and a sliding handle lever rod connected to be released from the sliding striker by applying tension to the sliding latch part upon the first operation.

Further, the sliding/swing composite door for a vehicle further includes a swing striker mounted on the inner surface of a vehicle body, a swing latch part configured to be located on the inner surface of the swing door, and to be fastened to or released from the swing striker, and a swing latch cable connected to be released from the swing striker by applying tension to the swing latch part upon the second operation.

Further, the sliding door further includes a first fixing part on the back surface thereof, and the first fixing part is configured to be connected to a swing handle lever rod located on one end of the outside handle to be rotatable.

Further, the swing door further includes a second fixing part formed to correspond to the location of the first fixing part at which the sliding door is fully opened and fastened to the first fixing part, and the second fixing part is integrally rotated by the rotation of the first fixing part upon the second operation, and a swing latch cable connected to the upper end of the second fixing part is configured to apply tension to a swing latch part to be released from the swing striker.

Further, the sliding/swing composite door for a vehicle further includes a first rail fixed to a vehicle body, and a first roller and a second roller located on the upper end of the sliding door are moved along the first rail in response to an open operation of the sliding door.

Further, the sliding/swing composite door for a vehicle further includes a second rail fixed to the back surface of the swing door and located lower than the first rail, and a third roller and a fourth roller located on the intermediate end of the sliding door are moved along the second rail in response to an operation of opening the sliding door.

Further, the sliding/swing composite door for a vehicle further includes an opening located on the edge of the first rail, and formed to correspond to the locations of the first roller and the second roller when the sliding door is fully opened.

Further, the sliding/swing composite door for a vehicle further includes a catch configured to be formed on one side end of the sliding door, and to be rotated in the case of being in contact with one end of the swing door, and a catch pin formed on one edge of the swing door to correspond to the location of the catch, in which if the sliding door is fully opened, the catch is rotated to be fitted into the catch pin.

Further, the sliding/swing composite door for a vehicle further includes a pawl adjacent to the catch, and the catch includes a locking protrusion on one end thereof, and the pawl includes a locking projection on one end of the location corresponding to the locking protrusion, such that the locking protrusion and the locking projection are configured to be engaged with each other.

Further, if a preset external force is applied in the closing direction of the sliding door or if the first operation is input to the outside handle, the locking protrusion and the locking projection are configured to be released to release the catch and the catch pin.

The present disclosure may obtain the following effects by the aforementioned present exemplary embodiments and the configuration, coupling, and use relationship to be described below.

Embodiments of the present disclosure may include both the spatial usability, which is the advantage of the sliding door, and the maximization of the opening width in the fully opened state, which is the advantage of the swing door, thereby maximizing the spatial usability.

Further, embodiments of the present disclosure may integrally rotate the sliding door and the swing door after the door is slid, thereby increasing the opening width even with the small rotational radius.

Further, embodiments of the present disclosure may provide the outside handle enabling the two stage operation designed as the structure corresponding to the opening method of the sliding or swing door, thereby enhancing the convenience of the passenger.

Further, embodiments of the present disclosure may improve the operational convenience by the operation of the outside handle matching with the opening direction of each of the sliding door and the swing door.

It is understood that the term "automotive" or "vehicular" or other similar term as used herein is inclusive of motor automotives in general such as passenger automobiles including sport utility vehicles (SUVs), buses, trucks, various commercial automotives, watercraft including a variety of boats and ships, aircraft, and the like, and includes hybrid automotives, electric automotives, plug-in hybrid electric automotives, hydrogen-powered automotives and other alternative fuel automotives (e.g., fuels derived from resources other than petroleum). As referred to herein, a hybrid automotive is an automotive that has two or more sources of power, for example both gasoline-powered and electric-powered automotives.

The above and other features of the disclosure are discussed infra.

BRIEF DESCRIPTION OF THE DRAWINGS

The above and other features of the present disclosure will now be described in detail with reference to certain exemplary examples thereof illustrated in the accompanying drawings which are given herein below by way of illustration only, and thus are not limitative of the present disclosure, and wherein.

Figure 1A:
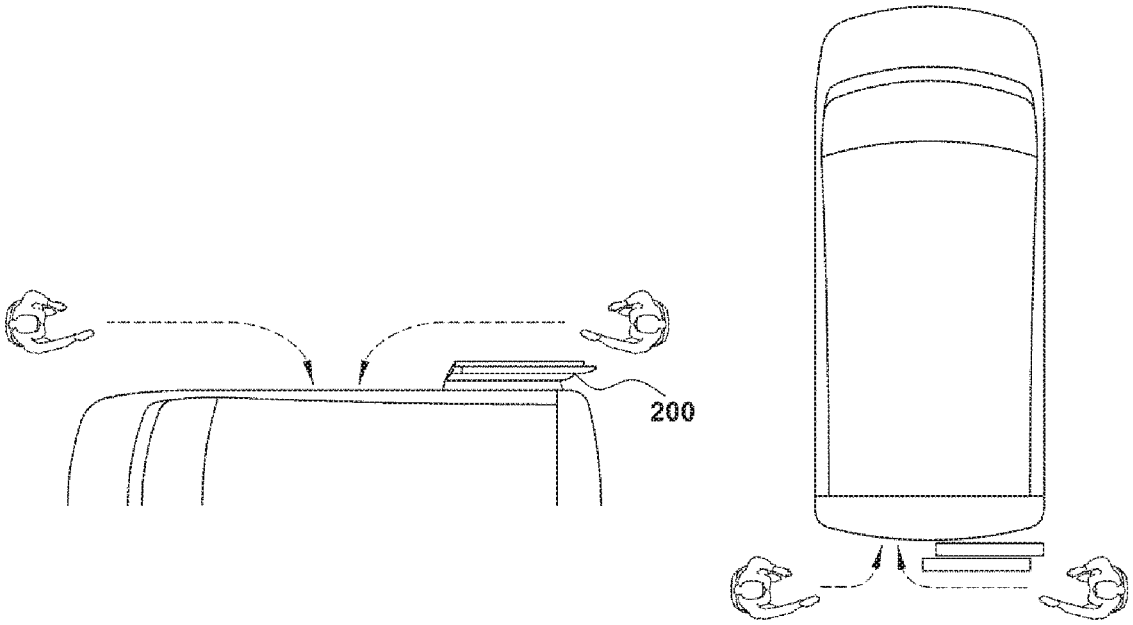
FIG. 1A illustrates a sliding open state of a sliding/swing composite door for a vehicle.

It should be understood that the appended drawings are not necessarily to scale, presenting a somewhat simplified representation of various preferred features illustrative of the basic principles of the disclosure. The specific design features of the present disclosure as disclosed herein, including, for example, specific dimensions, orientations, locations, and shapes will be determined in section by the particular intended application and use environment.

In the figures, reference numbers refer to the same or equivalent sections of the present disclosure throughout the several figures of the drawing.

DETAILED DESCRIPTION OF ILLUSTRATIVE EMBODIMENTS

Hereinafter, exemplary embodiments of the present disclosure will be described in more detail with reference to the accompanying drawings. The exemplary embodiments of the present disclosure may be modified in various forms, and the scope of the present disclosure should not be construed as being limited to the following exemplary embodiments. The present exemplary embodiment is provided to more completely describe the present disclosure to those skilled in the art.

Further, terms such as " . . . unit" described in the specification mean a unit of processing at least one function or operation, which may be implemented by hardware or a combination of hardware.

Further, in the present specification, a "height direction" means the height direction of a vehicle, and a "width direction" means the outside direction of the vehicle. A "longitudinal direction" means the direction in which a sliding door 200 is opened or closed.

Figure 1B:
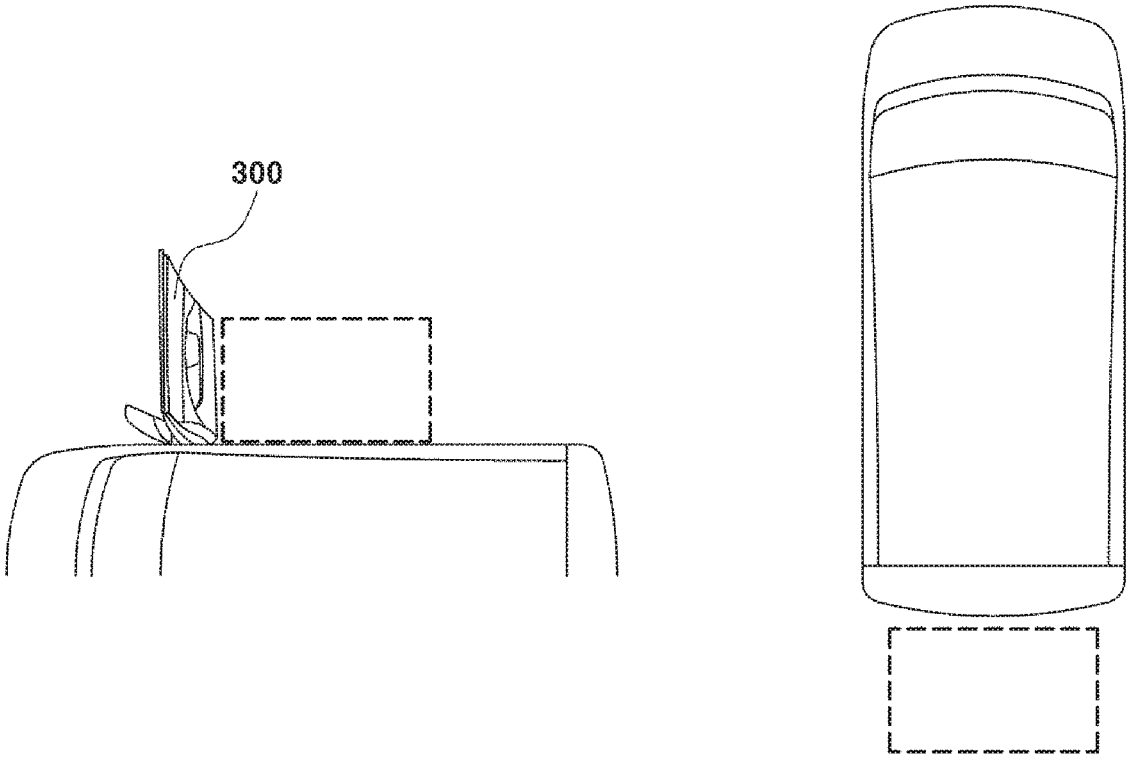
FIG. 1B illustrates a swing open state of the sliding/swing composite door for a vehicle.

The present disclosure relates to a sliding/swing composite door for a vehicle, and FIG. 1A illustrates a sliding open state of a sliding/swing composite door for a vehicle, and FIG. 1B illustrates a swing open state of the sliding/swing composite door for a vehicle.

The sliding door 200 may be configured to be opened or closed adjacent to a vehicle body 400 in the longitudinal direction of the vehicle body 400 to fully open or close a door even in a narrow space. As a result, it is possible to improve the convenience of getting in and out and easily secure a getting-in/out space. The sliding door 200 according to embodiments of the present disclosure may be configured to be opened or closed in the longitudinal direction of the vehicle body 400 along a first rail 410 fixed to the vehicle body 400 and a second rail 350 fixed to the back surface of a swing door 300.

One end of the swing door 300 may be hinge-coupled to the vehicle body 400 side of the other end surface of the sliding door 200. The other end of the swing door 300 may be pulled outward or pushed inward in the width direction of the vehicle body 400 around the hinge coupling. The sliding door 200 is fully opened and overlaps the swing door 300 to be integrally rotated, such that all areas of an opening of a vehicle may be opened, thereby easily securing the space in the case of loading the luggage with a large volume. The swing door 300 according to embodiments of the present disclosure may be configured to overlap the back surface of the sliding door 200 if the sliding door 200 is fully opened, and have a hinge coupling structure formed on one side to be rotated integrally with the fully opened sliding door 200.

Figure 2:
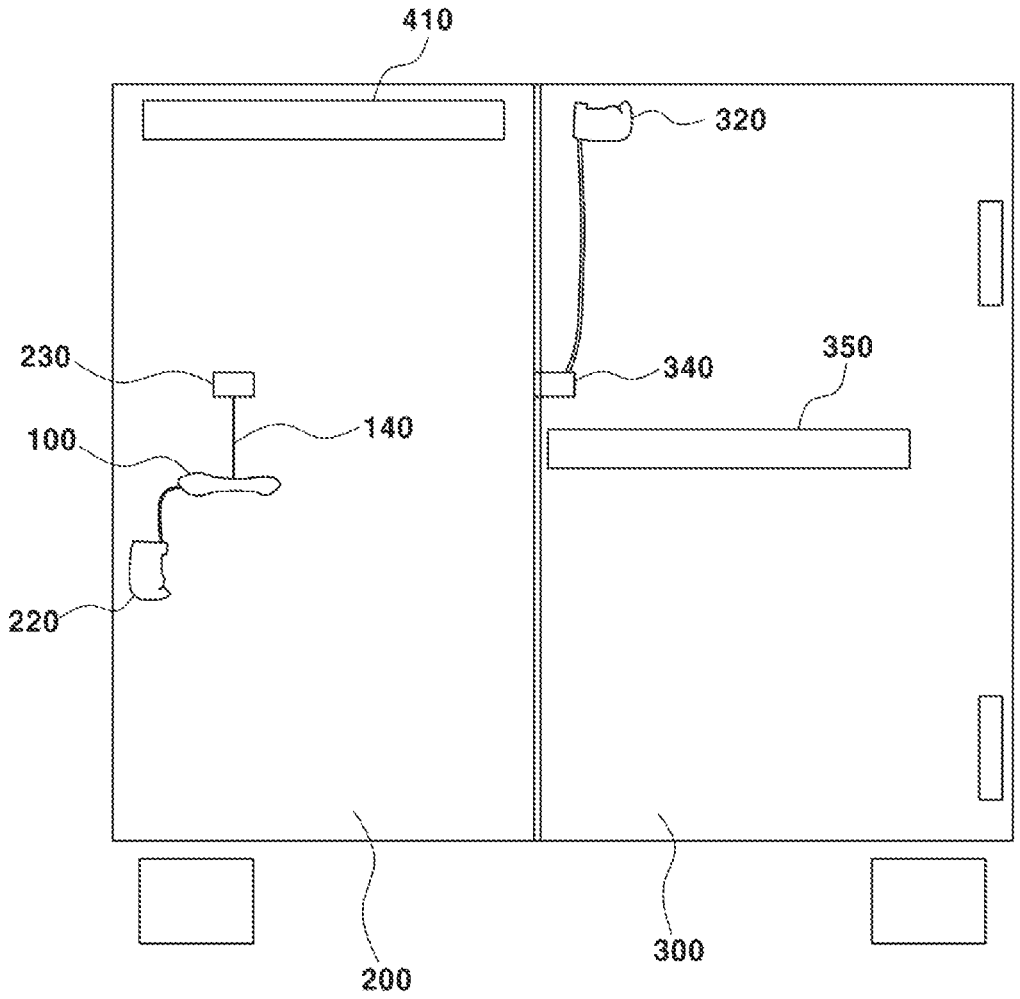
FIG. 2 is a front diagram illustrating the sliding/swing composite door for a vehicle, as an exemplary embodiment of the present disclosure.
Figure 3A:
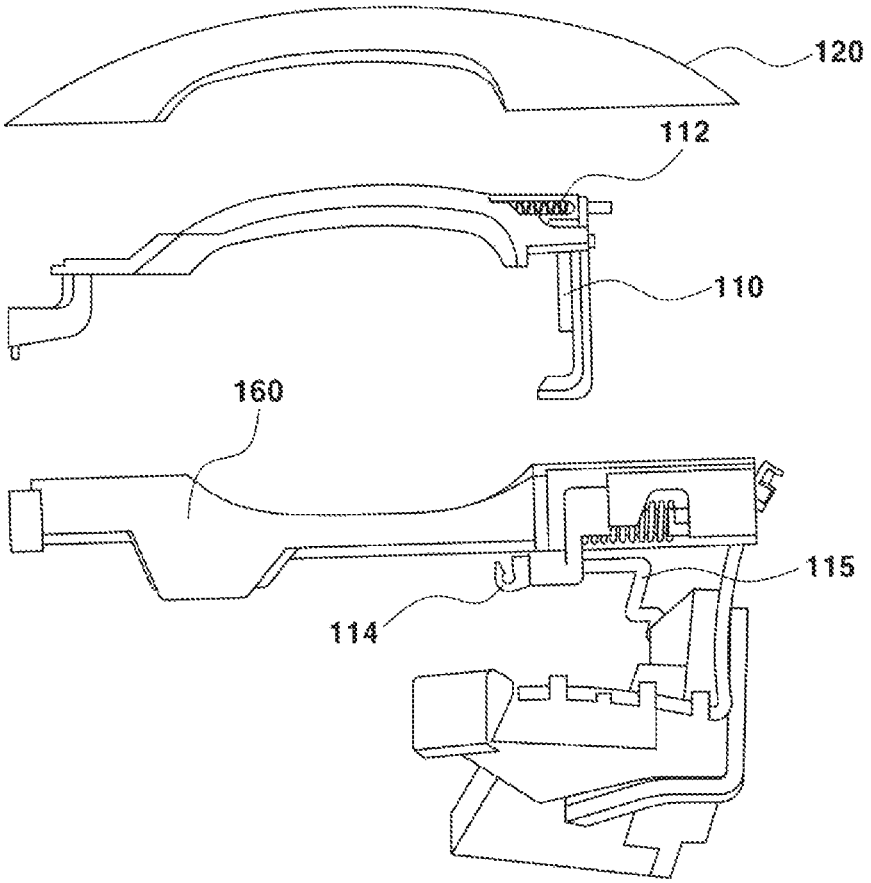
FIG. 3A illustrates an outside handle of the sliding/swing composite door for a vehicle, as an exemplary embodiment of the present disclosure.
Figure 3B:
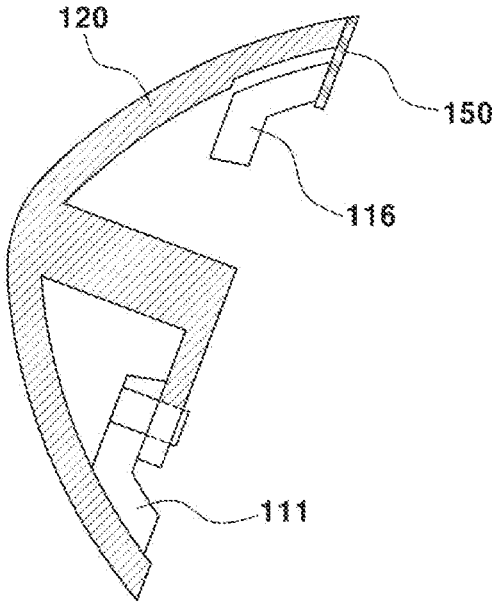
FIG. 3B is a side cross-sectional diagram illustrating the outside handle of the sliding/swing composite door for a vehicle, as an exemplary embodiment of the present disclosure.

FIG. 2 is a front diagram illustrating the sliding/swing composite door for a vehicle, as an exemplary embodiment of the present disclosure, FIG. 3A illustrates an outside handle of the sliding/swing composite door for a vehicle, as an exemplary embodiment of the present disclosure, and FIG. 3B is a side cross-sectional diagram illustrating the handle of the sliding/swing composite door for a vehicle, as an exemplary embodiment of the present disclosure.

Referring to FIG. 2, a sliding/swing composite door for a vehicle according to an exemplary embodiment of the present disclosure includes an outside handle located on the outer surface of the sliding door 200, the sliding door 200 opened upon a first operation of the outside handle, and the swing door 300 opened integrally with the sliding door 200 upon a second operation of the outside handle, and the swing door 300 may be rotated and opened in the state where the sliding door 200 is fully opened.

The outside handle may be located on the outer surface of the sliding door 200, and more preferably, located on the center portion in the height direction of the sliding door 200. Further, the outside handle may be configured to be connected to door latch parts 220, 320 to easily release the sliding door 200 and the swing door 300 from the vehicle body 400 while the door latch parts 220, 320 are released when the user operates an outside handle 100. The sliding door 200 and/or the swing door 300 may be opened or closed by only one outside handle 100 mounted on the vehicle body 400, thereby reducing the number and weight of related components of the outside handle 100 and saving the cost thereof.

The outside handle 100 may be configured such that a two-stage operation is possible. More preferably, upon a first operation, the sliding door 200 may be operated, and upon a second operation in a state where the sliding door 200 is fully opened, the sliding door 200 and the swing door 300 may be integrally rotated and opened.

Referring to FIGS. 3A and 3B, the outside handle may include a body portion no and a handle cover portion 120. The body portion no may be configured to include a sliding body in which is movable integrally with the handle cover portion 120 in the longitudinal direction upon the first operation and a swing body 116 which may be pulled integrally with the handle cover portion 120 upon the second operation.

The handle cover portion 120 may be configured to be formed to surround the body portion no and to protrude to the outer surface of the vehicle body 400. A handle base 160 may be configured to be connected to the sliding latch part 220.

The body portion no may be composed of the sliding body in and the swing body 116, and each of the sliding body in and the swing body 116 may be configured separately on the inner upper and lower ends of the handle cover portion 120. More preferably, the body portion no may be configured to form a body portion locking projection 150 inside the handle cover portion 120 such that the sliding body in and the handle cover portion 120 are fixed through a screw. The swing body 116 is not fixed to the handle cover portion 120 and freely movable and the height directional movement thereof may be restricted by the body portion locking projection 150.

A restoring spring 112 mounted on the body portion no may provide an elastic force such that a location thereof may be restored if the sliding body 111 is moved by the first operation in the longitudinal direction.

The handle cover portion 120 may be slid integrally with the sliding body 111 in the longitudinal direction of the vehicle by the first operation of the outside handle 100. The first operation may be an operation of pushing the outside handle 100 backward in the longitudinal direction of the vehicle. More preferably, the sliding door 200 may be fully opened by the first operation, and the fully opened sliding door 200 may be fixed to the swing door 300 configured to be located on the back surface thereof and to be integrally rotated and opened.

The sliding body in moved by the first operation in the longitudinal direction of the vehicle may be restored by the restoring spring 112. More preferably, the sliding body 111 may be restored to a location corresponding to a swing body. A sliding handle lever 114 may be rotated in the direction opposite to the rotational direction upon the first operation by an elastic force of a lever spring 113 connected to the sliding handle lever 114 and the location thereof may be restored.

After the sliding door 200 is fully opened, when the second operation is input to the outside handle 100, the sliding door 200 and the swing door 300 may be integrally rotated and additionally opened. The second operation may be an operation of pulling the outside handle 100. The handle cover portion 120 and the body portion 110 may be integrally pulled by the second operation.

Figure 3C:
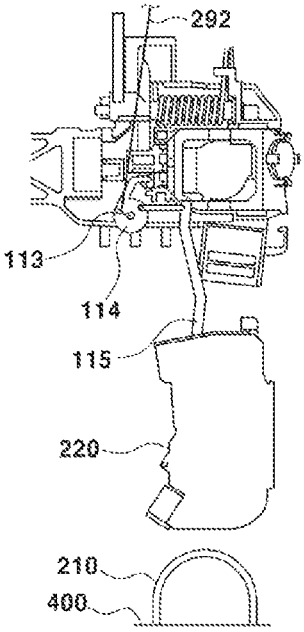
FIG. 3C is a plan diagram illustrating main pails of the sliding/swing composite door for a vehicle, as an exemplary embodiment of the present disclosure.
Figure 3D:
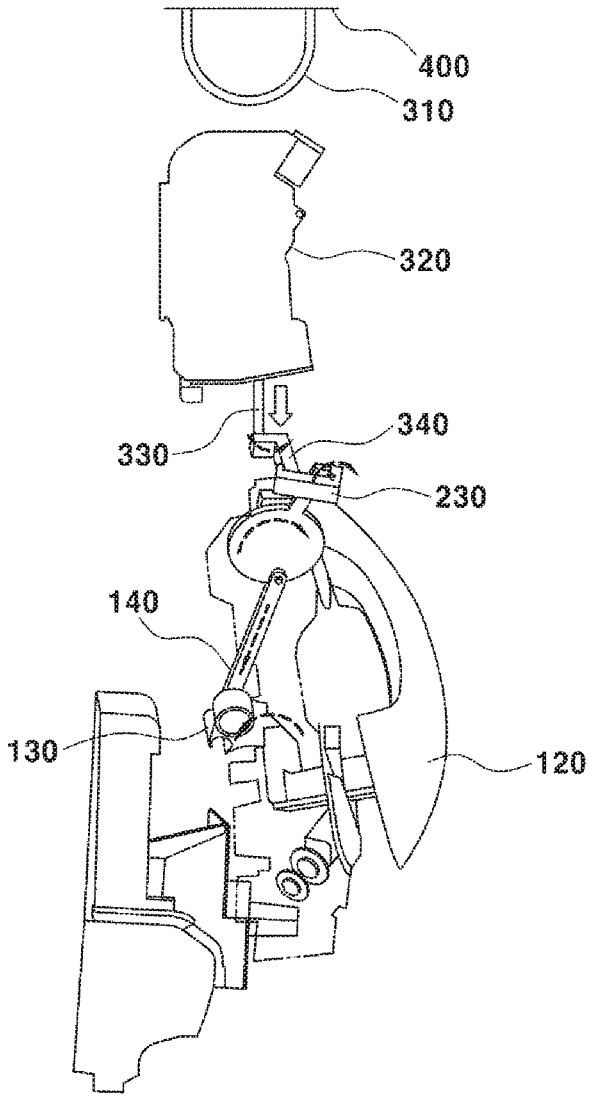
FIG. 3D is a plan diagram upon a second operation of the outside handle of the sliding/swing composite door for a vehicle, as an exemplary embodiment of the present disclosure.

FIG. 3C is a plan diagram illustrating main parts of the sliding/swing composite door for a vehicle, as an exemplary embodiment of the present disclosure, and FIG. 3D is a plan diagram upon a second operation of the outside handle 100 of the sliding/swing composite door for a vehicle, as an exemplary embodiment of the present disclosure.

Referring to FIGS. 3C and 3D, the sliding/swing composite door for the vehicle according to an exemplary embodiment of the present disclosure may further include a sliding striker 210 mounted on the inner surface of the vehicle body 400, a sliding latch part 220 configured to be located on the inner surface of the sliding door 200, and to be fastened to or released from the sliding striker 210, and a sliding handle lever rod 115 for applying tension to the sliding latch part 220 upon the first operation to be connected to be released from the sliding striker 210. Further, the sliding/swing composite door for the vehicle according to an exemplary embodiment of the present disclosure may further include a swing striker 310 mounted on the inner surface of the vehicle body 400, a swing latch part 320 configured to be located on the inner surface of the swing door 300, and to be fastened to or released from the swing striker 310, and a swing latch cable 330 for applying tension to the swing latch part 320 upon the second operation to be connected to be released from the swing striker 310.

The sliding handle lever 114 may be connected to the edge of the sliding body in of the outside handle 100. More preferably, when the sliding body 111 is moved by the first operation in the longitudinal direction, the sliding handle lever 114 may be connected to be rotated.

Further, the sliding handle lever rod 115 eccentrically connected to the rotational reference axis of the sliding handle lever 114 may be formed. The sliding handle lever 114 may be rotated by the first operation, and may apply tension to the sliding handle lever rod 115. Further, the sliding handle lever 114 may also be connected to a release cable 292 connected to a pawl 290.

The sliding handle lever rod 115 may extend to the lower end of the outside handle 100 and be connected to the sliding latch part 220. The sliding handle lever rod 115 to which tension is applied may be configured to release the sliding latch part 220.

The sliding latch part 220 may be configured to be formed on the lower end of the outside handle 100 and to be fastened to or released from the sliding striker 210. The sliding striker 210 may be fixed to the inner cross-sectional surface of the vehicle body 400 to correspond to the location of the sliding latch part 220.

The sliding latch part 220 may be released from the sliding striker 210 by the first operation. More preferably, the sliding handle lever 114 may be rotated by the first operation of the outside handle, and may apply tension to the eccentrically connected sliding handle lever rod 115 by the rotation of the sliding handle lever 114.

The sliding handle lever rod 115 may apply tension to the sliding latch part 220 such that the sliding latch part 220 is decoupled from the sliding striker 210 upon input of the first operation. When the sliding latch part 220 and the sliding striker 210 are decoupled, the passenger may push the outside handle backward in the longitudinal direction to open the sliding door 200.

In the sliding/swing composite door for the vehicle according to an exemplary embodiment of the present disclosure, the sliding door 200 may further include a first fixing part 230 on the back surface thereof, and the first fixing part 230 may be configured to be connected to the swing handle lever rod 140 located on one end of the outside handle 100 to be rotatable. Further, the swing door 300 may further include a second fixing part 340 which may be formed to correspond to the location of the first fixing part 230 at which the sliding door 200 is fully opened and fastened to the first fixing part 230, and may be configured such that the second fixing part 340 is rotated by the rotation of the first fixing part 230 upon the second operation, and the swing latch cable 330 connected to the upper end of the second fixing part 340 is released from the swing striker 310 by applying tension to the swing latch part 320.

When the swing body 116 is pulled by the second operation, the swing handle lever 130 may be connected to be rotated.

Further, the swing handle lever rod 140 eccentrically connected to the rotational reference axis of the swing handle lever 130 may be formed. The swing handle lever 130 may be rotated by the second operation, and may apply tension to the swing handle lever rod 140.

The swing handle lever rod 140 may be formed to be connected to the first fixing part 230 located on the back surface of the sliding door 200. More preferably, when tension is applied to the swing handle lever rod 140 by the second operation, the first fixing part 230 may be connected to be rotated.

The first fixing part 230 may be formed to contact the second fixing part 340. More preferably, the first fixing part 230 located on the back surface of the sliding door 200 may contact the second fixing part 340 located on one edge of the swing door 300 if the sliding door 200 is fully opened.

The second fixing part 340 may be connected to the swing latch cable 330. More preferably, the swing latch cable 330 extending to the upper end of the outside handle 100 may be formed to connect the second fixing part 340 to the swing latch part 320. The swing latch cable 330 to which tension is applied may be configured to release the swing latch part 320.

The swing latch part 320 may be configured to be formed on the upper portion in the height direction of the outside handle 100 and to be coupled to the swing striker 310. The swing striker 310 may be fixed to the inner cross-sectional surface of the vehicle body 400 to correspond to the location of the swing latch part 320.

The swing latch part 320 may be released from the swing striker 310 by the second operation. More preferably, when the outside handle 100 is pulled by the second operation, the tension is applied to the swing latch cable 330 and the swing latch part 320 and the swing striker 310 may be decoupled.

Upon the second operation in the state where the sliding door 200 is fully opened, the sliding door 200 and the swing door 300 may be integrally opened additionally. That is, when the sliding door 200 is fully opened, the first fixing part 230 may be configured to be fastened to the second fixing part 340. More preferably, the first fixing part 230 may be configured to have a predetermined separation distance on the back surface of the sliding door 200, and the second fixing part 340 may be configured to have a predetermined separation distance on the front surface of one edge of the swing door 300, such that the first fixing part 230 and the second fixing part 340 may be formed to be engaged with each other.

Upon the second operation after the sliding door 200 is fully opened, the swing handle lever rod 140 may be operated to rotate the first fixing part 230. The rotated first fixing part 230 may be configured to be rotated in engagement with the second fixing part 340 to apply tension to the swing latch cable 330. The swing latch cable 330 may be configured to apply tension to the swing latch part 320 to be released from the swing striker 310. When the swing latch part 320 and the swing striker 310 are released, the sliding door 200 and the swing door 300 may be integrally opened additionally.

The second fixing part 340 may be formed on the swing door 300 to correspond to the location of the first fixing part 230 at which the sliding door 200 is fully opened. More preferably, when the sliding door 200 is fully opened, the first fixing part 230 of the sliding door 200 and the second fixing part 340 of the swing door 300 may contact each other.

Figure 4A:
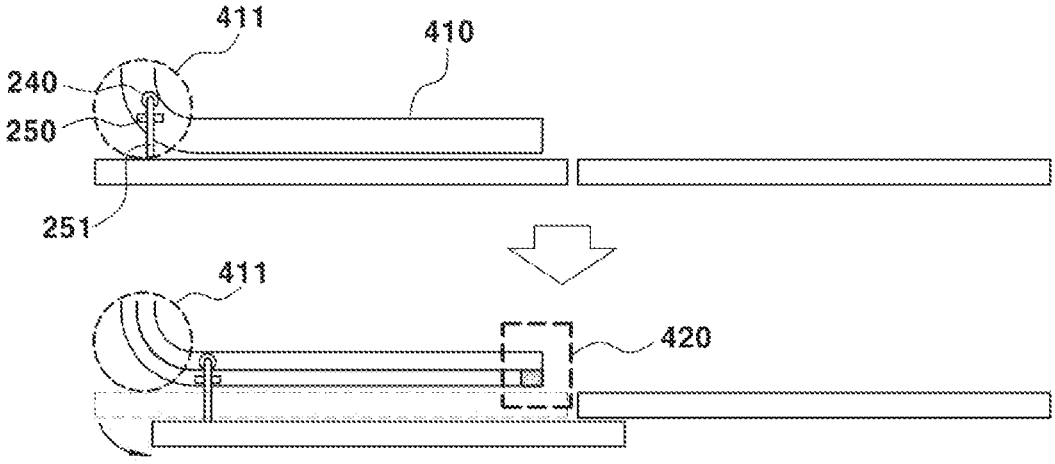
FIG. 4A illustrates a first rail, a first roller, and a second roller of the sliding/swing composite door for a vehicle, as an exemplary embodiment of the present disclosure.

FIG. 4A illustrates a first rail, a first roller, and a second roller of the sliding/swing composite door for a vehicle, as an exemplary embodiment of the present disclosure.

Referring to FIG. 4A, the sliding/swing composite door for a vehicle according to an exemplary embodiment of the present disclosure may further include a first rail 410 fixed to the vehicle body 400, and may be configured such that the first roller 240 and the second roller 250 located on the upper end of the sliding door 200 move along the first rail 410 in response to the open operation of the sliding door 200. Further, the first roller 240 may be configured to limit the width directional movement of the sliding door 200, and the second roller 250 may be configured to limit the height directional movement of the sliding door 200.

The first rail 410 may be fixed to the vehicle body 400 and formed in the longitudinal direction, which is a movement direction of the sliding door 200. More preferably, as illustrated in FIG. 2, the first rail 410 may be formed on the upper end of the vehicle body 400 to correspond to the upper end of the sliding door 200. Further, a bending portion 411 may be formed on one edge of the first rail 410.

During the operation of opening or closing the sliding door 200, the first roller 240 and the second roller 250 may be connected to a first roller guide 251 to move along the first rail 410. More preferably, the first roller 240 may be coupled to one end of the roller guide located on the upper end of the sliding door 200 to limit the width directional movement when the sliding door 200 is opened or closed. The second roller 250 may be coupled to the other end of the first roller guide 251 located on the upper end of the sliding door 200 to limit the height directional movement when the sliding door 200 is opened or closed.

The first roller 240 and the second roller 250 may be spaced apart from the sliding door 200 to move along the first rail 410. More preferably, the first roller 240 and the second roller 250 may be configured to be spaced apart by a first roller guide 251 to move between the inner surface of the first rail 410 and the back surface of the sliding door 200 and open or close the sliding door 200. Further, the sliding door 200 may be spaced apart by the first roller guide 251 along the bending portion 411 of the first rail 410 to be opened or closed. The bending portion 411 may be configured to be popped-up for avoiding interference with the swing door 300 when the sliding door 200 is moved.

Further, referring to FIG. 4A, the sliding/swing composite door for a vehicle according to an exemplary embodiment of the present disclosure may further include an opening 420 located on the edge of the first rail 410, and formed to correspond to the locations of the first roller 240 and the second roller 250 when the sliding door 200 is fully opened. More preferably, the sliding door 200 is fully opened through the opening 420, and when the sliding door 200 is rotated integrally with the swing door 300 to be swung and opened, the first roller 240 and the second roller 250 may escape the first rail 410.

Figure 4B:
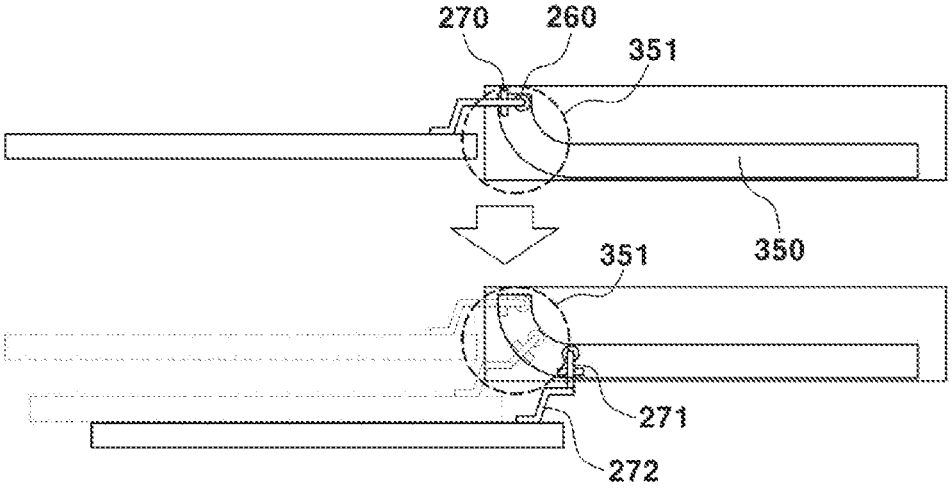
FIG. 4B illustrates a second rail, a third roller, and a fourth roller of the sliding/swing composite door for a vehicle, as an exemplary embodiment of the present disclosure.

FIG. 4B illustrates a second rail, a third roller, and a fourth roller of the sliding/swing composite door for a vehicle, as an exemplary embodiment of the present disclosure.

Referring to FIG. 4B, the sliding/swing composite door for a vehicle according to an exemplary embodiment of the present disclosure may further include the second rail 350 fixed to the back surface of the swing door 300, and located lower than the first rail 410, and a third roller 260 and a fourth roller 270 located on the intermediate end of the sliding door 200 may be configured to move along the second rail 350 in response to the open operation of the sliding door 200. Further, the third roller 260 may be configured to limit the width directional movement of the sliding door 200, and the fourth roller 270 may be configured to limit the height directional movement of the sliding door 200.

The second rail 350 may be fixed to the back surface of the swing door 300 and formed in the longitudinal direction, which is a movement direction of the sliding door 200. More preferably, as illustrated in FIG. 2, the second rail 350 may be formed lower than the first rail 410, and formed on the intermediate end of the swing door 300 to correspond to the intermediate end of the sliding door 200. Further, the second rail 350 may be configured such that a bending portion 351 is formed on one edge thereof.

During the operation of opening or closing the sliding door 200, the third roller 260 and the fourth roller 270 may be connected to a second roller guide 271 to move along the second rail 350. More preferably, the third roller 260 may be coupled to one end of the second roller guide 271 located on the intermediate end of the sliding door 200 to limit the width directional movement when the sliding door 200 is opened or closed. The fourth roller 270 may be coupled to the other end of the second roller guide 271 located on the intermediate end of the sliding door 200 to limit the height directional movement when the sliding door 200 is opened or closed.

The third roller 260 and the fourth roller 270 may be spaced apart from the sliding door 200 to move along the second rail 350. More preferably, the third roller 260 and the fourth roller 270 may be configured to be spaced apart by the second roller guide 271 to move between the inner surface of the second rail 350 and the back surface of the sliding door 200 and to open or close the sliding door 200. Further, a back surface fastening part 272 of the sliding door 200 may be configured to be hinge-coupled to one end of the second roller guide 271 to apply the degree of freedom when the sliding door 200 is moved in the longitudinal direction.

Further, the sliding door 200 may be spaced apart by the second roller guide 271 along the bending portion 351 of the second rail 350 to be opened or closed. The bending portion 351 may be configured to be popped-up for avoiding interference with the swing door 300 when the sliding door 200 moves.

Figure 5A:
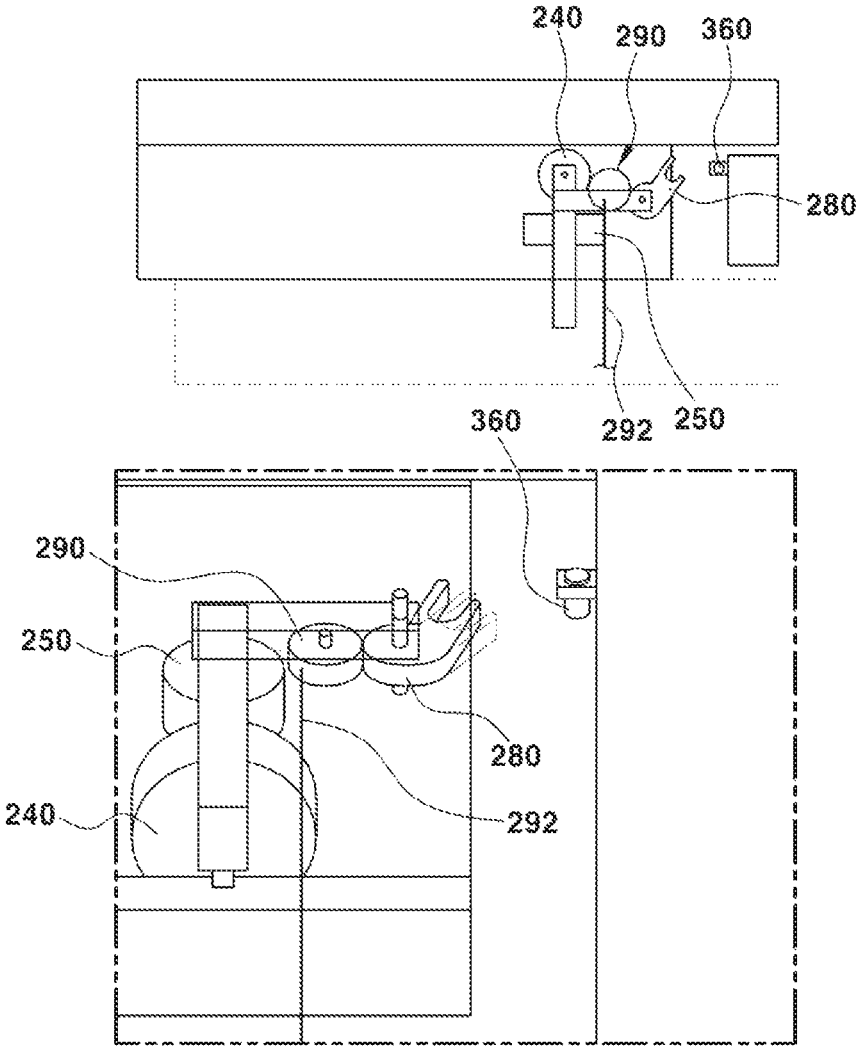
FIG. 5A illustrates a catch and a catch pin upon a sliding operation of the sliding/swing composite door for a vehicle, as an exemplary embodiment of the present disclosure.
Figure 5B:
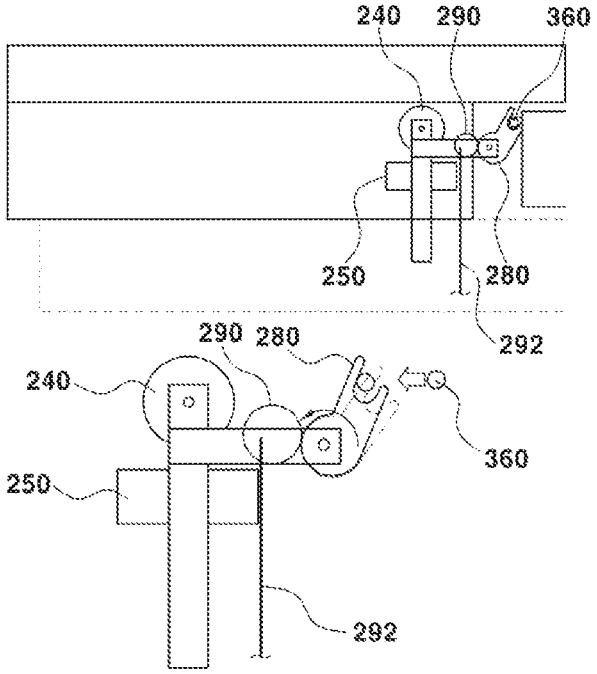
FIG. 5B illustrates the catch and the catch pin if the sliding/swing composite door for a vehicle is fully opened, as an exemplary embodiment of the present disclosure.

FIG. 5A illustrates a catch and a catch pin upon a sliding operation of the sliding/swing composite door for a vehicle, as an exemplary embodiment of the present disclosure, and FIG. 5B illustrates a catch and a catch pin if the sliding/swing composite door for a vehicle is fully opened, as an exemplary embodiment of the present disclosure.

Referring to FIGS. 5A and 5B, the sliding/swing composite door for a vehicle according to an exemplary embodiment of the present disclosure may further include a catch 280 formed on one side end of the sliding door 200 and configured to be rotatable in the case of contacting one end of the swing door 300, and a catch pin 360 formed on one edge of the swing door 300 to correspond to the location of the catch 280, and may be configured such that the catch 280 is rotated to fit into the catch pin 360 if the sliding door 200 is fully opened.

The catch 280 may be configured to be formed on one side end of the sliding door 200 and to be rotated by contacting one end of the swing door 300 while the sliding door 200 is opened. More preferably, the catch 280 may be coupled to the first roller guide 251 of the upper end of the sliding door 200 to move toward one end of the swing door 300 together with the first roller 240 and the second roller 250 during the open operation of the sliding door 200.

The catch pin 360 may be formed on one edge of the swing door 300 to correspond to the location of the catch 280, and the catch 280 may be configured to be fitted into the catch pin 360, and to be fixed by the pawl 290 adjacent to the catch 280. More preferably, one end of the catch 280 and the shape of the catch pin 360 may be formed to correspond to each other such that the catch 280 may be rotated to surround the catch pin 360 and fixed to the pawl 290 if the sliding door 200 is fully opened.

The catch 280 may have a shape having an opening so as to surround the catch pin 360, and just before the sliding door 200 is fully opened, the catch pin 360 may be introduced into the opening. If the sliding door 200 is fully opened, the opening of the catch 280 may be in contact with one end of the swing door 300, and the catch 280 is additionally rotated to surround the catch pin 360, such that the catch 280 and the catch pin 360 may be fixed.

Figure 5C:
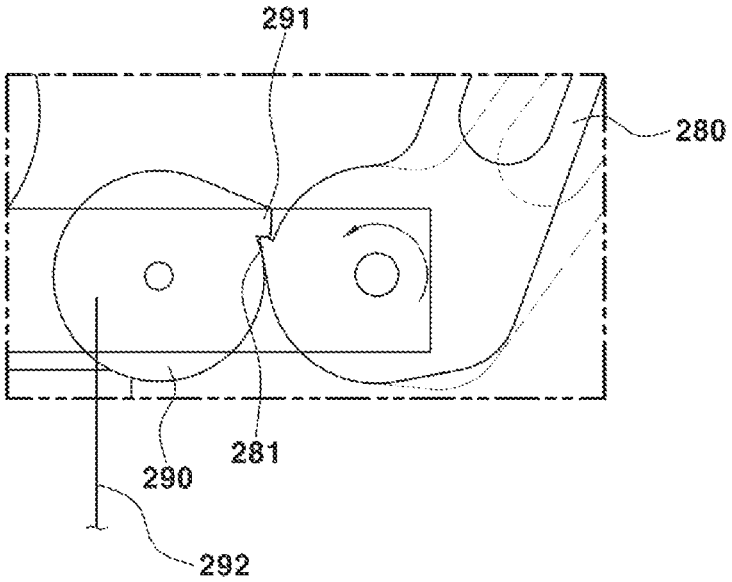
FIG. 5C illustrates a pawl and the catch upon full open of the sliding/swing composite door for a vehicle, as an exemplary embodiment of the present disclosure.

FIG. 5C illustrates a pawl and a catch upon full open of the sliding/swing composite door for a vehicle, as an exemplary embodiment of the present disclosure.

Referring to FIG. 5C, the sliding/swing composite door for a vehicle according to an exemplary embodiment of the present disclosure may further include the pawl 290 adjacent to the catch 280, and be configured such that the catch 280 includes a locking protrusion 281 on one end thereof, the pawl 290 includes a locking projection 291 on one end at a location corresponding to the locking protrusion 281, and the locking protrusion 281 and the locking projection 291 are engaged with each other.

The pawl 290 may be configured to be located adjacent to the catch 280 and to be rotated in conjunction with the catch 280. The catch 280 rotated by the full open of the sliding door 200 may have the locking protrusion 281 formed on one end thereof, which is engaged with the locking projection 291 formed on one end of the pawl 290, thereby maintaining the state where the catch 280 is fixed to the catch pin 360. As a result, the sliding door 200 may be fixed to be rotated integrally with the swing door 300.

The locking protrusion 281 may be formed in a shape corresponding to the locking projection 291 of the pawl 290 on one end of the catch 280. The locking projection 291 may be configured to be formed on one end of the pawl 290 and to be unlocked from the locking protrusion 281 if a constant external force is applied. More preferably, the locking protrusion 281 and the locking projection 291 may be configured to be not unlocked if an external force smaller than a preset value is applied.

Referring to FIG. 5C, the sliding/swing composite door for a vehicle according to an exemplary embodiment of the present disclosure may be configured such that the locking protrusion 281 and the locking projection 291 are released to release the catch 280 and the catch pin 360 if a preset external force is applied in the closing direction of the sliding door 200 or if the first operation is input to the outside handle 100.

The sliding door 200 and the swing door 300 may be fixed such that the sliding door 200 may be rotated integrally with the swing door 300 in the state of being fully opened. One end of the pawl 290 and one end of the sliding handle lever 114 may be connected by the release cable 292. More preferably, one edge of the release cable 292 may be eccentrically connected to the rotary shaft of the pawl 290, and the other edge thereof may be eccentrically connected to the rotary shaft of the sliding handle lever 114.

Upon the first operation which moves the handle cover portion 120 in the sliding direction in order to release the connection between the sliding door 200 and the swing door 300, the sliding handle lever 114 may be rotated to apply tension to the release cable 292 connected to the pawl 290. Then, when the release cable 292 applies the tension to the pawl 290 and the pawl 290 is rotated, the catch 280 may be rotated such that the locking protrusion 281 may escape the locking projection 291. Therefore, the sliding door 200 and the swing door 300 may be released to close the sliding door 200.

If the sliding handle lever 114 receives the external force opposite to the input value of the first operation, or the sliding latch part 220 is in contact with the sliding striker 210 to move in the direction in which the sliding door 200 is fully closed, the sliding latch part 220 may be switched to the state of being locked with the sliding striker 210. More preferably, if the sliding handle lever 114 receives the external force opposite to the input value of the first operation, or the sliding latch part 220 is in contact with the sliding striker 210 to move in the direction in which the sliding door 200 is fully closed, the sliding latch part 220 may be configured to be rotated in the opposite direction upon input of the first operation to move the sliding handle lever rod 115. The sliding latch part 220 may be locked and fastened to the sliding striker 210 depending on the movement direction of the sliding handle lever rod 115.

In summary, embodiments of the present disclosure relate to the composite door combining the respective advantages by coupling the sliding method and the swing method to the door system of the vehicle, and provide the sliding/swing composite door for a vehicle which may open or close the door in the sliding method and the swing method by changing the operation method of the single outside handle 100.

Figure 6:
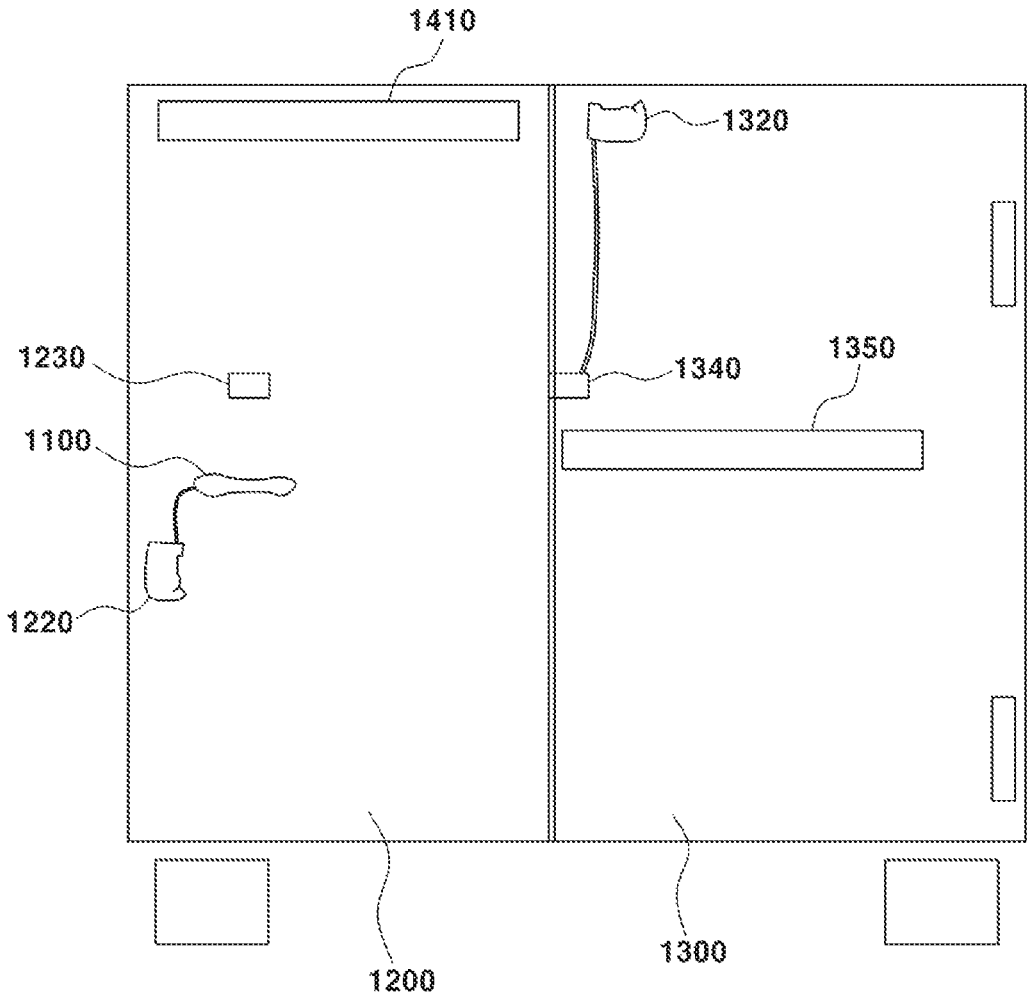
FIG. 6 is a front diagram illustrating a sliding/swing composite door for a vehicle, as another exemplary embodiment of the present disclosure.
Figure 7A:
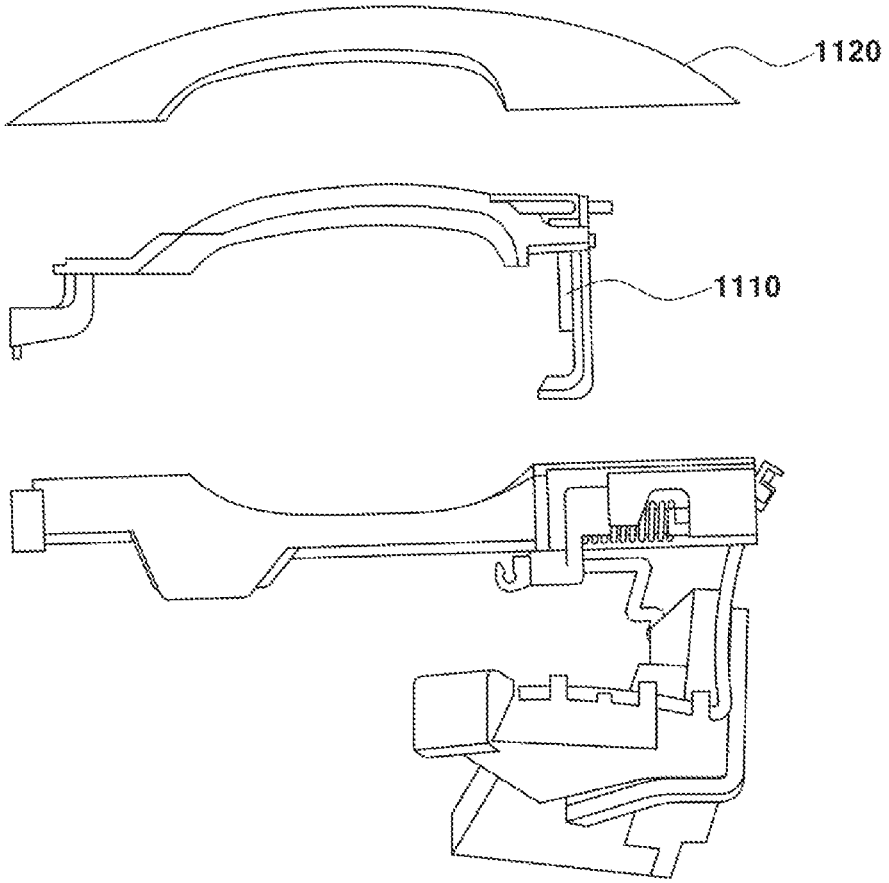
FIG. 7A illustrates an outside handle of the sliding/swing composite door for a vehicle, as another exemplary embodiment of the present disclosure.
Figure 7B:
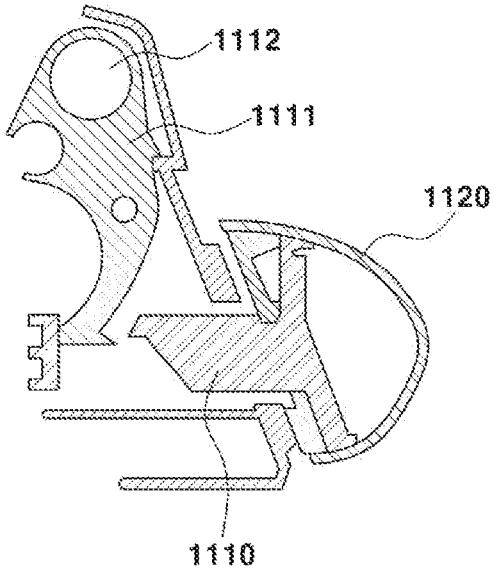
FIG. 7B is a side cross-sectional diagram illustrating the outside handle of the sliding/swing composite door for a vehicle, as another exemplary embodiment of the present disclosure.

FIG. 6 is a front diagram illustrating a sliding/swing composite door for a vehicle, as another exemplary embodiment of the present disclosure, FIG. 7A illustrates an outside handle of the sliding/swing composite door for a vehicle, as another exemplary embodiment of the present disclosure, and FIG. 7B is a side cross-sectional diagram illustrating the handle of the sliding/swing composite door for a vehicle, as another exemplary embodiment of the present disclosure.

Referring to FIG. 6, a sliding/swing composite door for a vehicle according to another exemplary embodiment of the present disclosure includes an outside handle located on the outer surface a sliding door 1200, the sliding door 1200 being opened in response to an input value of the outside handle, and a swing door 1300 being opened integrally with the sliding door 1200 in response to the input value of the outside handle. The swing door 1300 may be rotated and opened in a state where the sliding door 1200 is fully opened.

The outside handle may be located on the outer surface of the sliding door 1200, and more preferably, located on the central portion in the height direction of the sliding door 1200. Further, the outside handle may be configured such that the outside handle is connected to the door latch parts 1220, 1320 and when the user operates an outside handle 1100, the door latch parts 1220, 1320 may be released to easily release the sliding door 1200 and the swing door 1300 from a vehicle body 1400. The sliding door 1200 and/or the swing door 1300 may be opened or closed by only one outside handle 1100 mounted on the vehicle body 1400, thereby reducing the number and weight of related components of the outside handle 1100 and saving the cost thereof.

An input value of the outside handle 1100 may be an operation of pulling the door in a direction away from the vehicle body. More preferably, the sliding door 1200 may be first opened in response to the input value, and if the input value is applied to the outside handle 1100 again in the state where the sliding door 1200 is fully opened, the sliding door 1200 and the swing door 1300 may be integrally rotated and opened.

Referring to FIGS. 7A and 7B, the outside handle 1100 may include a body portion 1110 and a handle cover portion 1120. The body portion 1110 may be configured to be pulled integrally with the handle cover portion 1120 in response to the input value.

The handle cover portion 1120 may be configured to be formed to surround the body portion 1110 and to protrude to the outer surface of the vehicle body 1400. A handle base may be configured to be connected to the sliding latch part 1220.

Upon an operation of pushing the sliding door 1200 backward in the longitudinal direction after the input value is applied to the outside handle 1100, the sliding door 1200 may be fully opened. The fully opened sliding door 1200 may be configured to be fixed to the swing door 1300 located on the back surface thereof to be movable integrally.

The body portion 1110 may be configured to rotate a sliding handle lever 1111. If the sliding handle lever 1111 is rotated by the movement of the body portion 1110, the sliding handle lever rod 1112 may be connected to be vertically moved.

After the sliding door 1200 is fully opened, when the input value is applied to the outside handle 1100, the sliding door 1200 and the swing door 1300 may be integrally rotated and additionally opened.

Figure 7C:
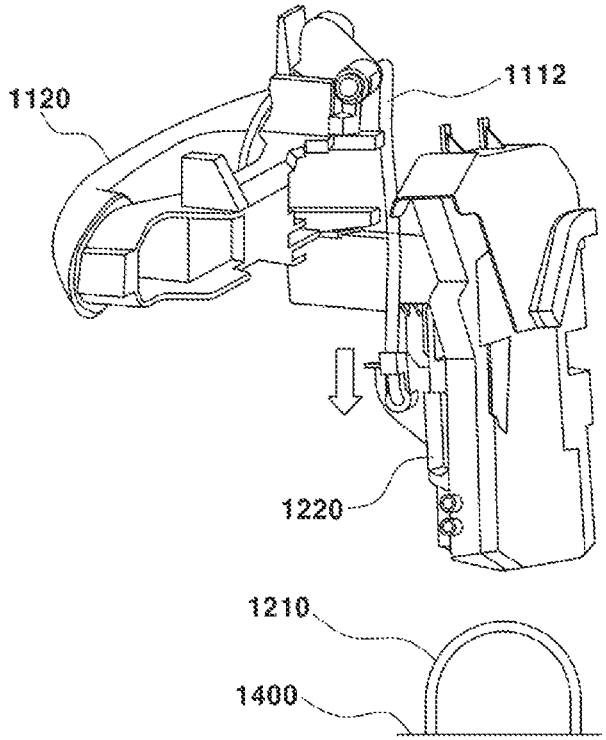
FIG. 7C is a perspective diagram illustrating main parts of the sliding/swing composite door for a vehicle, as another exemplary embodiment of the present disclosure.
Figure 7D:
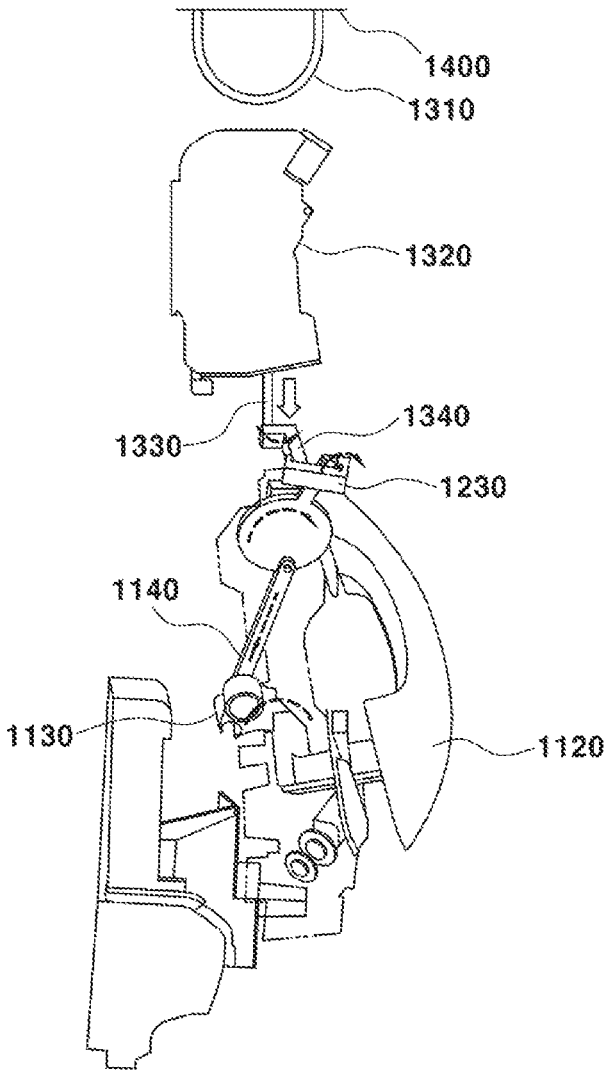
FIG. 7D is a plan diagram when a swing door is opened in response to an input value of the outside handle of the sliding/swing composite door for a vehicle, as another exemplary embodiment of the present disclosure.

FIG. 7C is a perspective diagram illustrating main parts of the sliding/swing composite door for a vehicle, as another exemplary embodiment of the present disclosure, and FIG. 7D is a plan diagram when a swing door is opened in response to an input value of the outside handle 1100 of the sliding/swing composite door for a vehicle, as another exemplary embodiment of the present disclosure.

Referring to FIGS. 7C and 7D, the sliding/swing composite door for a vehicle according to another exemplary embodiment of the present disclosure may further include a sliding striker 1210 mounted on the inner surface of the vehicle body 1400, a sliding latch part 1220 configured to be located on the inner surface of the sliding door 1200, and to be fastened to or released from the sliding striker 1210, and a sliding handle lever rod 1112 connected to be released from the sliding striker 1210 by applying tension to the sliding latch part 1220 in response to the input value. Further, the sliding/swing composite door for a vehicle according to another exemplary embodiment of the present disclosure may further include a swing striker 1310 mounted on the inner surface of the vehicle body 1400, a swing latch part 1320 configured to be located on the inner surface of the swing door 1300, and to be fastened to or released from the swing striker 1310, and a swing latch cable 1330 connected to be released from the swing striker 1310 by applying tension to the swing latch part 1320 in response to the input value.

One end of the body portion 1110 of the outside handle 1100 may be connected with the sliding handle lever 1111. More preferably, the sliding handle lever 1111 may be connected such that the sliding handle lever 1111 is rotated when the body portion 1110 is moved in response to the input value of the outside handle.

Further, a sliding handle lever rod 1112 eccentrically connected to the rotational reference axis of the sliding handle lever 1111 may be formed. The sliding handle lever 1111 may be rotated in response to the input value of the outside handle, and the tension may be applied to the sliding handle lever rod 1112. Further, the sliding handle lever 1111 may be connected to a release cable 1292 connected to a pawl 1290.

The sliding handle lever rod 1112 may extend to the lower end of the outside handle 1100 and be connected to the sliding latch part 1220. The sliding handle lever rod 1112 to which tension is applied may be configured to release the sliding latch part 1220.

The sliding latch part 1220 may be configured to be formed on the lower end of the outside handle 1100 and to be fastened to or released from the sliding striker 1210. The sliding striker 1210 may be fixed to the inner cross-sectional surface of the vehicle body 1400 to correspond to the location of the sliding latch part 1220.

The sliding latch part 1220 may be released from the sliding striker 1210 in response to the input value of the outside handle 1100. More preferably, the sliding handle lever 1111 may be rotated in response to the input value of the outside handle 1100, and tension may be applied to the sliding handle lever rod 1112 eccentrically connected by the rotation of the sliding handle lever 1111.

The sliding handle lever rod 1112 may apply tension to the sliding latch part 1220 such that the sliding latch part 1220 is decoupled from the sliding striker 1210 in response to the input value of the outside handle 1100. When the sliding latch part 1220 and the sliding striker 1210 are decoupled, the passenger may push the outside handle backward in the longitudinal direction to open the sliding door 1200.

The sliding/swing composite door for a vehicle according to another exemplary embodiment of the present disclosure may be configured such that the sliding door 1200 further includes a first fixing part 1230 on the back surface thereof, and the first fixing part 1230 is connected to a swing handle lever rod 1140 located on one end of the outside handle 1100 to be rotatable. Further, the sliding/swing composite door for a vehicle according to another exemplary embodiment of the present disclosure may be configured such that the swing door 1300 further includes a second fixing part 1340 which may be formed to correspond to the location of the first fixing part 1230 at which the sliding door 1200 is fully opened and fastened to the first fixing part 1230, the second fixing part 1340 is rotated by the rotation of the first fixing part 1230 responding to the input value of the outside handle, and the swing latch cable 1330 connected to the upper end of the second fixing part 1340 applies tension to the swing latch part 1320 to be released from the swing striker 1310.

The sliding handle lever 1130 may be connected such that the sliding handle lever 1130 is rotated when the body portion 1110 is moved in response to the input value of the outside handle 1100.

Further, the swing handle lever rod 1140 eccentrically connected to the rotational reference axis of the swing handle lever 1130 may be formed. The swing handle lever 1130 may be rotated in response to the input value of the outside handle 1100, and may apply tension to the swing handle lever rod 1140.

The swing handle lever rod 1140 may be formed to be connected to the first fixing part 1230 located on the back surface of the sliding door 1200. More preferably, the first fixing part 1230 may be connected such that the first fixing part 1230 is rotated when the tension is applied to the swing handle lever rod 1140 in response to the input value of the outside handle.

The first fixing part 1230 may be formed to be in contact with the second fixing part 1340. More preferably, the first fixing part 1230 located on the back surface of the sliding door 1200 may be in contact with the second fixing part 1340 located on one edge of the swing door 1300 if the sliding door 1200 is fully opened.

The second fixing part 1340 may be connected to the swing latch cable 1330. More preferably, the swing latch cable 1330 extending to the upper end of the outside handle 1100 may be formed to connect the second fixing part 1340 to the swing latch part 1320. The swing latch cable 1330 to which tension is applied may be configured to release the swing latch part 1320.

The swing latch part 1320 may be configured to be formed on the upper portion in the height direction of the outside handle 1100 and to be coupled to the swing striker 1310. The swing striker 1310 may be fixed to the inner cross-sectional surface of the vehicle body 1400 to correspond to the location of the swing latch part 1320.

The swing latch part 1320 may be released from the swing striker 1310 in response to the input value of the outside handle 1100. More preferably, when the outside handle 1100 is pulled in response to the input value of the outside handle 1100, tension is applied to the swing latch cable 1330 and thus the swing latch part 1320 and the swing striker 1310 may be decoupled.

If the input value is applied to the outside handle 1100 in the state where the sliding door 1200 is fully opened, the sliding door 1200 and the swing door 1300 may be integrally opened additionally. That is, when the sliding door 1200 is fully opened, the first fixing part 1230 may be configured to be fastened to the second fixing part 1340. More preferably, the first fixing part 1230 may be configured to have a predetermined separation distance on the back surface of the sliding door 1200, and the second fixing part 1340 may be configured to have a predetermined separation distance on the front surface of one edge of the swing door 1300 to be formed to be engaged with the first fixing part 1230.

If the input value of the outside handle 1100 is applied after the sliding door 1200 is fully opened, the swing handle lever rod 1140 may be operated to rotate the first fixing part 1230. The rotated first fixing part 1230 may be configured to be rotated in engagement with the second fixing part 1340 to apply tension to the swing latch cable 1330. The swing latch cable 1330 may be configured to apply tension to the swing latch part 1320 to be released from the swing striker 1310. When the swing latch part 1320 and the swing striker 1310 are released, the sliding door 1200 and the swing door 1300 may be integrally opened additionally.

The second fixing part 1340 may be formed on the swing door 1300 to correspond to the location of the first fixing part 1230 at which the sliding door 1200 is fully opened. More preferably, when the sliding door 1200 is fully opened, the first fixing part 1230 of the sliding door 1200 and the second fixing part 1340 of the swing door 1300 may be in contact with each other.

Figure 8A:
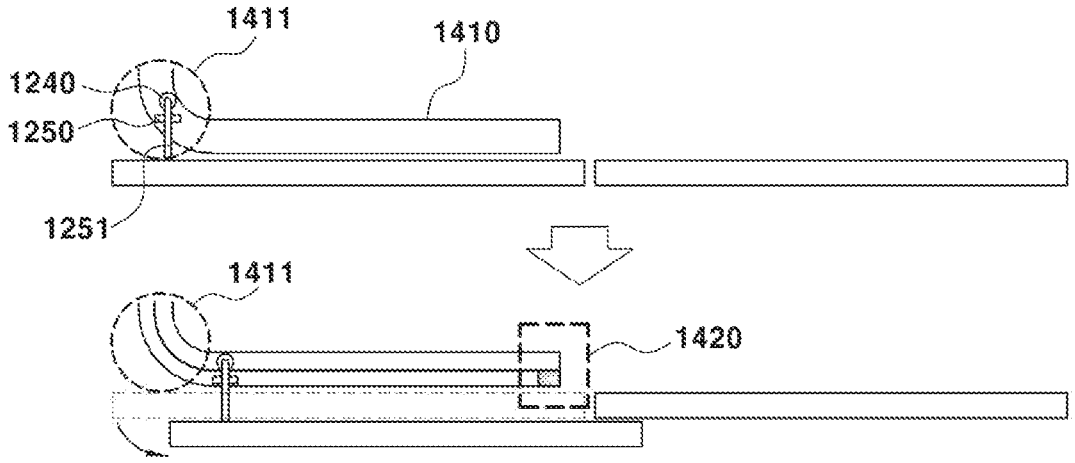
FIG. 8A illustrates a first rail, a first roller, and a second roller of the sliding/swing composite door for a vehicle, as another exemplary embodiment of the present disclosure.

FIG. 8A illustrates a first rail, a first roller, and a second roller of the sliding/swing composite door for a vehicle, as another exemplary embodiment of the present disclosure.

Referring to FIG. 8A, the sliding/swing composite door for a vehicle according to another exemplary embodiment of the present disclosure may further include a first rail 1410 fixed to the vehicle body 1400, and configured such that a first roller 1240 and a second roller 1250 located on the upper end of the sliding door 1200 move along the first rail 1410 in response to the open operation of the sliding door 1200. Further, the first roller 1240 may be configured to limit the width directional movement of the sliding door 1200, and the second roller 1250 may be configured to limit the height directional movement of the sliding door 1200.

The first rail 1410 may be fixed to the vehicle body 1400 and formed in the longitudinal direction, which is a movement direction of the sliding door 1200. More preferably, as illustrated in FIG. 6, the first rail 1410 may be formed on the upper end of the vehicle body 1400 to correspond to the upper end of the sliding door 1200. Further, a bending portion 1411 may be formed on one edge of the first rail 1410.

During the operation of opening or closing the sliding door 1200, the first roller 1240 and the second roller 1250 may be connected to the first roller guide 1251 to move along the first rail 1410. More preferably, the first roller 1240 may be coupled to one end of the first roller guide 1251 located on the upper end of the sliding door 1200 to limit the width directional movement when the sliding door 1200 is opened or closed. The second roller 1250 may be coupled to the other end of the first roller guide 1251 located on the upper end of the sliding door 1200 to limit the height directional movement when the sliding door 1200 is opened or closed.

The first roller 1240 and the second roller 1250 may be spaced apart from the sliding door 1200 to move along the first rail 1410. More preferably, the first roller 1240 and the second roller 1250 may be configured to be spaced apart by the first roller guide 1251 to move between the inner surface of the first rail 1410 and the back surface of the sliding door 1200 and to open or close the sliding door 1200. Further, the sliding door 1200 may be spaced apart by the first roller guide 1251 to be opened or closed along the bending portion 1411 of the first rail 1410. The bending portion 1411 may be configured to be popped-up for avoiding interference with the swing door 1300 when the sliding door 1200 is moved.

Further, referring to FIG. 8A, the sliding/swing composite door for a vehicle according to another exemplary embodiment of the present disclosure may further include an opening 1420 located on the edge of the first rail 1410, and formed to correspond to the locations of the first roller 1240 and the second roller 1250 when the sliding door 1200 is fully opened. More preferably, if the sliding door 1200 is fully opened through the opening 1420 and rotates integrally with the swing door 1300 to be swung and opened, the first roller 1240 and the second roller 1250 may escape the first rail 1410.

Figure 8B:
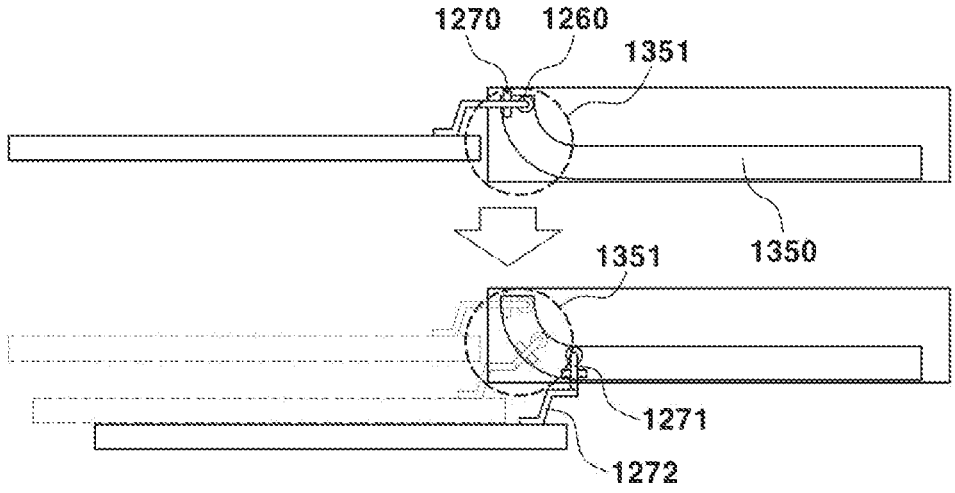
FIG. 8B illustrates a second rail, a third roller, and a fourth roller of the sliding/swing composite door for a vehicle, as another exemplary embodiment of the present disclosure.

FIG. 8B illustrates a second rail, a third roller, and a fourth roller of the sliding/swing composite door for a vehicle, as another exemplary embodiment of the present disclosure.

Referring to FIG. 8B, the sliding/swing composite door for a vehicle according to another exemplary embodiment of the present disclosure may further include a second rail 1350 fixed to the back surface of the swing door 1300 and located lower than the first rail 1410, and may be configured such that a third roller 1260 and a fourth roller 1270 located on the intermediate end of the sliding door 1200 move along the second rail 1350 in response to the open operation of the sliding door 1200. Further, the third roller 1260 may be configured to limit the width directional movement of the sliding door 1200, and the fourth roller 1270 may be configured to limit the height directional movement of the sliding door 1200.

The second rail 1350 may be fixed to the back surface of the swing door 1300 and formed along the longitudinal direction, which is a movement direction of the sliding door 1200. More preferably, as illustrated in FIG. 6, the second rail 1350 may be formed lower than the first rail 1410, and formed on the intermediate end of the swing door 1300 to correspond to the intermediate end of the sliding door 1200. Further, a bending portion 1351 may be formed on one edge of the second rail 1350.

During the operation of opening or closing the sliding door 1200, the third roller 1260 and the fourth roller 1270 may be connected to a second roller guide 1271 to move along the second rail 1350. More preferably, the third roller 1260 may be coupled to one end of the second roller guide 1271 located on the intermediate end of the sliding door 1200 to limit the width directional movement when the sliding door 1200 is opened or closed. The fourth roller 1270 may be coupled to the other end of the second roller guide 1271 located on the intermediate end of the sliding door 1200 to limit the height directional movement when the sliding door 1200 is opened or closed.

The third roller 1260 and the fourth roller 1270 may be spaced apart from the sliding door 1200 to move along the second rail 1350. More preferably, the third roller 1260 and the fourth roller 1270 may be configured to be spaced apart by the second roller guide 1271 to move between the inner surface of the second rail 1350 and the back surface of the sliding door 1200 and to open or close the sliding door 1200. Further, a back surface fastening part 1272 of the sliding door 1200 may be configured to be hinge-coupled to one end of the second roller guide 1271 to apply the degree of freedom when the sliding door 1200 is moved in the longitudinal direction.

Further, the sliding door 1200 may be spaced apart by the second roller guide 1271 along the bending portion 1351 of the second rail 1350 to be opened or closed. The bending portion 1351 may be configured to be popped-up for avoiding interference with the swing door 1300 when the sliding door 1200 is moved.

Figure 9A:
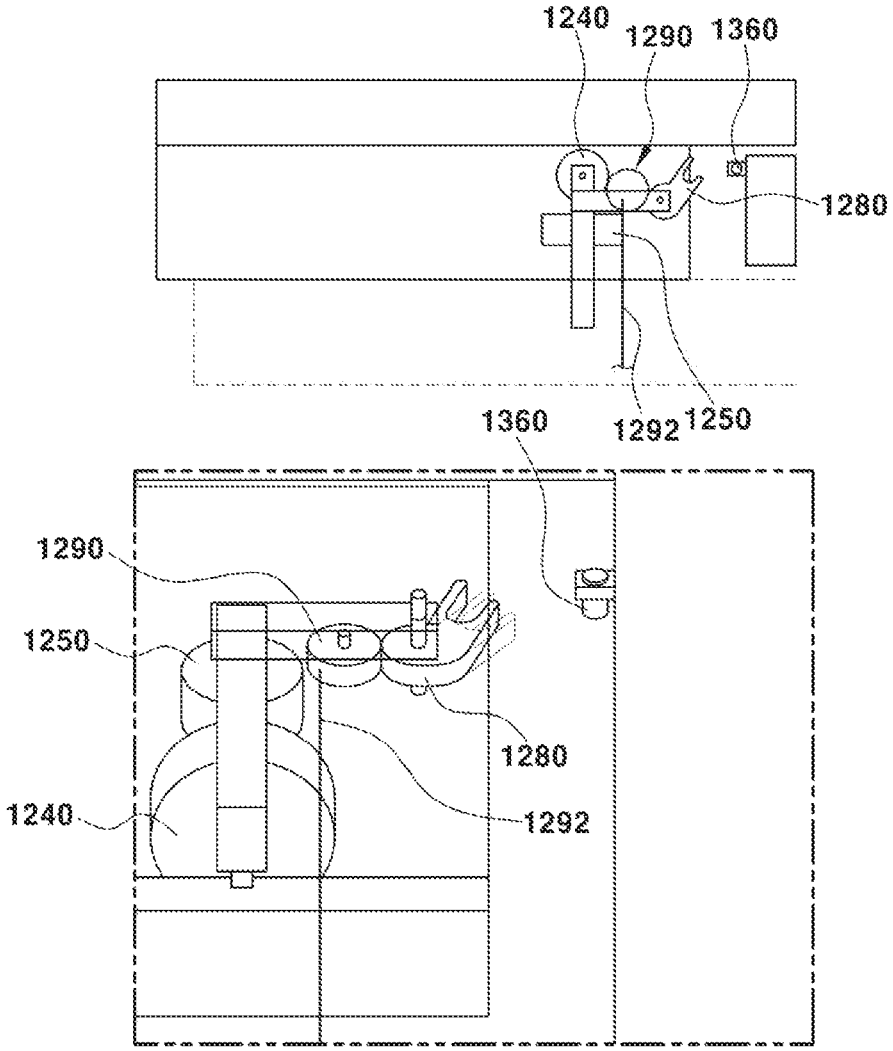
FIG. 9A illustrates a catch and a catch pin upon sliding operation of the sliding/swing composite door for a vehicle, as another exemplary embodiment of the present disclosure.
Figure 9B:
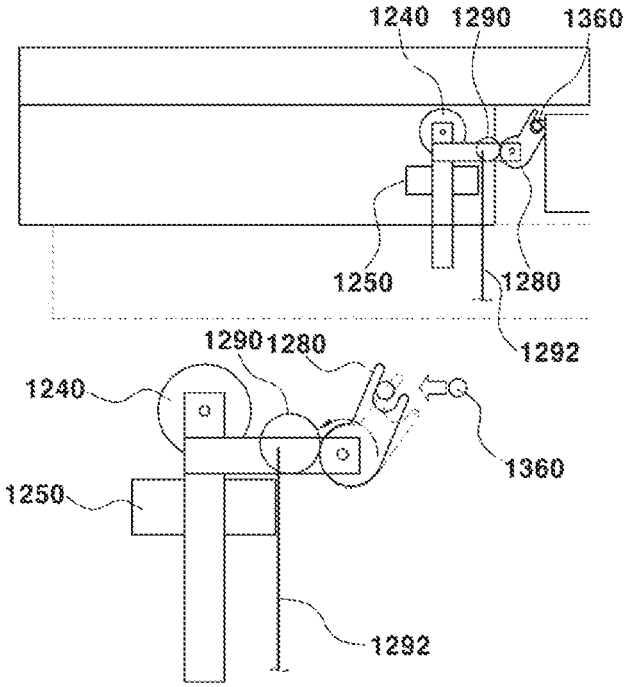
FIG. 9B illustrates the catch and the catch pin if the sliding/swing composite door for a vehicle is fully opened, as another exemplary embodiment of the present disclosure.

FIG. 9A illustrates a catch and a catch pin upon sliding operation of the sliding/swing composite door for a vehicle, as another exemplary embodiment of the present disclosure, and FIG. 9B illustrates the catch and the catch pin if the sliding/swing composite door for a vehicle is fully opened, as another exemplary embodiment of the present disclosure.

Referring to FIGS. 9A and 9B, the sliding/swing composite door for a vehicle according to another exemplary embodiment of the present disclosure may further include a catch 1280 configured to be formed on one side end of the sliding door 1200 and to be rotatable when being in contact with one end of the swing door 1300, and a catch pin 1360 formed on one edge of the swing door 1300 to correspond to the location of the catch 1280, and may be configured such that if the sliding door 1200 is fully opened, the catch 1280 may be rotated to be fitted into the catch pin 1360.

The catch 1280 may be configured to be formed on one side end of the sliding door 1200 and to be rotated by contacting one end of the swing door 1300 while the sliding door 1200 is opened. More preferably, the catch 1280 may be coupled to the first roller guide 251 of the upper end of the sliding door 1200 to move toward one end of the swing door 1300 together with the first roller 1240 and the second roller 1250 during the open operation of the sliding door 1200.

The catch pin 1360 may be formed on one edge of the swing door 1300 to correspond to the location of the catch 1280, and the catch 1280 may be configured to be fitted into the catch pin 1360, and to be fixed by the pawl 1290 adjacent to the catch 1280. More preferably, one end of the catch 1280 and the shape of the catch pin 1360 may be formed to correspond to each other such that the catch 1280 may be rotated to surround the catch pin 1360 and be fixed to the pawl 1290 if the sliding door 1200 is fully opened.

The catch 1280 may have a shape having an opening so as to surround the catch pin 1360, and just before the sliding door 1200 is fully opened, the catch pin 1360 may be introduced into the opening. If the sliding door 1200 is fully opened, the opening of the catch 1280 may be in contact with one end of the swing door 1300, and the catch 1280 is additionally rotated to surround the catch pin 1360, such that the catch 1280 and the catch pin 1360 may be fixed.

Figure 9C:
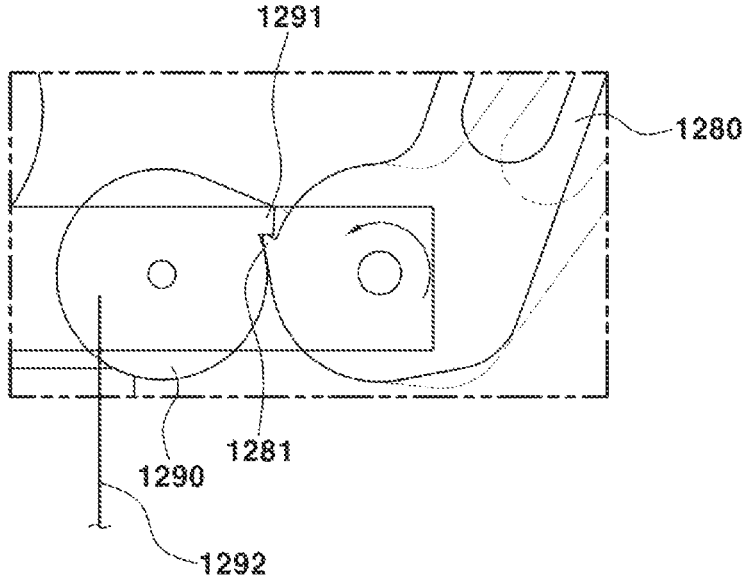
FIG. 9C illustrates a pawl and the catch upon full open of the sliding/swing composite door for a vehicle, as another exemplary embodiment of the present disclosure.

FIG. 9C illustrates a pawl and the catch upon full open of the sliding/swing composite door for a vehicle, as another exemplary embodiment of the present disclosure.

Referring to FIG. 9C, the sliding/swing composite door for a vehicle according to another exemplary embodiment of the present disclosure may further include the pawl 1290 adjacent to the catch 1280, and may be configured such that the catch 1280 includes a locking protrusion 1281 on one end thereof, the pawl 1290 includes a locking projection 1291 on one end of the location corresponding to the locking protrusion 1281, and the locking protrusion 1281 and the locking projection 1291 are engaged with each other.

The pawl 1290 may be configured to be located adjacent to the catch 1280 and to be rotated in conjunction with each other. The catch 1280 rotated by the full open of the sliding door 1200 may have the locking protrusion 1281 formed on one end thereof, which is engaged with the locking projection 1291 formed on one end of the pawl 1290, thereby maintaining the state where the catch 1280 is fixed to the catch pin 1360. As a result, the sliding door 1200 may be fixed to be rotated integrally with the swing door 1300.

The locking protrusion 1281 may be formed in a shape corresponding to the locking projection 1291 of the pawl 1290 on one end of the catch 1280. The locking projection 1291 may be formed on one end of the pawl 1290, and configured to be unlocked from the locking protrusion 1281 if a constant external force is applied. More preferably, the locking protrusion 1281 and the locking projection 1291 may be configured to be not unlocked if an external force smaller than a preset value is applied.

Referring to FIG. 9C, the sliding/swing composite door for a vehicle according to another exemplary embodiment of the present disclosure may be configured such that the locking protrusion 1281 and the locking projection 1291 are released in response to the input value of the outside handle 1100 to release the catch 1280 and the catch pin 1360.

The sliding door 1200 and the swing door 1300 may be fixed such that the sliding door 1200 may be rotated integrally with the swing door 1300 in the state of being fully opened. One end of the pawl 1290 and one end of the sliding handle lever 1111 may be connected by the release cable 1292. More preferably, one edge of the release cable 1292 may be eccentrically connected to the rotary shaft of the pawl 1290, and the other edge thereof may be eccentrically connected to the rotary shaft of the sliding handle lever 1111.

When the input value is applied to the outside handle 1100 to disconnect between the sliding door 1200 and the swing door 1300, the sliding handle lever 1111 may be rotated to apply tension to the release cable 1292 connected to the pawl 1290. Then, when the release cable 1292 applies tension to the pawl 1290 and the pawl 1290 is rotated, the catch 1280 may be rotated such that the locking protrusion 1281 may escape the locking projection 1291. Therefore, the sliding door 1200 and the swing door 1300 may be released to close the sliding door 1200.

If the sliding latch part 1220 is in contact with the sliding striker 1210 to move in a direction in which the sliding door 1200 is fully closed, the sliding latch part 1220 may be switched to a state of being locked with the sliding striker 1210. More preferably, if the sliding latch part 1220 is in contact with the sliding striker 1210 to move in a direction in which the sliding door 1200 is fully closed, the sliding handle lever 1111 may move the sliding handle lever rod 1112. The sliding latch part 1220 may be locked and fastened to the sliding striker 1210 depending on the movement direction of the sliding handle lever rod 1112.

In summary, embodiments of the present disclosure relate to the composite door combining the respective advantages by coupling the sliding method and the swing method to the door system of the vehicle, and provides the sliding/swing composite door for a vehicle which may open or close the door in the sliding method and the swing method with the input value of the single outside handle.

The above detailed description exemplifies the present disclosure. Further, the aforementioned contents illustrate and describe preferred exemplary embodiments of the present disclosure, and the present disclosure may be used in various other combinations, changes, and environments. That is, the present disclosure may be changed or modified within the scope of the concept of the disclosure disclosed in the present specification, the scope equivalent to the disclosed content, and/or the scope of the skill or knowledge in the art. The described exemplary embodiments describe the best mode for implementing the technical spirit of the present disclosure, and various changes required in the specific application fields and uses of the present disclosure are possible. Therefore, the aforementioned detailed description of the disclosure is not intended to limit the present disclosure to the disclosed exemplary embodiments. Further, the appended claims should be interpreted as further including other exemplary embodiments.

What is claimed is:

1. A sliding/swing composite door for a vehicle comprising:

a sliding door;

an outside handle located on an outer surface of the sliding door, wherein the sliding door is configured to be opened upon a first operation of the outside handle; and a swing door configured to be opened integrally with the sliding door upon a second operation of the outside handle, wherein the swing door is configured to be rotated and opened in a state where the sliding door is fully opened;

wherein the outside handle comprises a handle cover portion and a body portion, the body portion comprising a sliding body configured to be movable integrally with the handle cover portion in a sliding direction upon the first operation and a swing body configured to be pulled integrally with the handle cover portion upon the second operation.

2. The sliding/swing composite door of claim 1, further comprising:

a sliding striker mounted on an inner surface of a vehicle body;

a sliding latch part located on an inner surface of the sliding door and configured to be fastened to or released from the sliding striker; and a sliding handle lever rod configured to be released from the sliding striker by applying tension to the sliding latch part upon the first operation.

3. The sliding/swing composite door of claim 1, further comprising:

a swing striker mounted on an inner surface of a vehicle body;

a swing latch part located on an inner surface of the swing door and configured to be fastened to or released from the swing striker; and a swing latch cable configured to be released from the swing striker by applying tension to the swing latch part upon the second operation.

4. The sliding/swing composite door of claim 1, wherein the sliding door further comprises a first fixing part on a back surface of the sliding door, wherein the first fixing part is configured to be connected to a swing handle lever rod located on one end of the outside handle to be rotatable.

5. The sliding/swing composite door of claim 4, wherein the swing door further comprises a second fixing part formed to correspond to a location of the first fixing part at which the sliding door is fully opened and fastened to the first fixing part, wherein the second fixing part is configured to be integrally rotated by a rotation of the first fixing part upon the second operation, and wherein a swing latch cable connected to an upper end of the second fixing part is configured to apply tension to a swing latch part to be released from a swing striker.

6. The sliding/swing composite door of claim 1, further comprising a first rail fixed to a vehicle body, wherein a first roller and a second roller located on an upper end of the sliding door are configured to be moved along the first rail in response to an operation of opening the sliding door.

7. The sliding/swing composite door of claim 6, further comprising a second rail fixed to a back surface of the swing door and located lower than the first rail, wherein a third roller and a fourth roller located on an intermediate end of the sliding door are configured to be moved along the second rail in response to the operation of opening the sliding door.

8. The sliding/swing composite door of claim 6, further comprising an opening located on an edge of the first rail and formed to correspond to locations of the first roller and the second roller when the sliding door is fully opened.

9. The sliding/swing composite door of claim 1, further comprising:

a catch formed on one side end of the sliding door and configured to be rotated when in contact with one end of the swing door; and a catch pin formed on one edge of the swing door to correspond to a location of the catch, wherein if the sliding door is fully opened, the catch is configured to be rotated to be fitted into the catch pin.

10. The sliding/swing composite door of claim 9, further comprising a pawl adjacent to the catch, wherein the catch comprises a locking protrusion on one end of the catch, and wherein the pawl comprises a locking projection on one end at a location corresponding to the locking protrusion, such that the locking protrusion and the locking projection are configured to be engaged with each other.

11. The sliding/swing composite door of claim 10, wherein if a preset external force is applied in a closing direction of the sliding door or if the first operation is input to the outside handle, the locking protrusion and the locking projection are configured to be released to release the catch and the catch pin.

12. A sliding/swing composite door for a vehicle comprising:

a sliding door;

an outside handle located on an outer surface of the sliding door, wherein the sliding door is configured to be opened in response to an input value of the outside handle; and a swing door configured to be opened integrally with the sliding door in response to the input value of the outside handle, wherein the swing door is configured to be rotated and opened in a state where the sliding door is fully opened;

wherein the outside handle comprises a body portion; and a handle cover portion, wherein the body portion is configured to be operated integrally with the handle cover portion in response to the input value;

a sliding body configured to be movable integrally with the handle cover portion in a sliding direction upon the input value indicating a first operation; and a swing body configured to be pulled integrally with the handle cover portion upon the input value indicating a second operation.

13. The sliding/swing composite door of claim 12, further comprising:

a sliding striker mounted on an inner surface of a vehicle body;

a sliding latch part located on an inner surface of the sliding door and configured to be fastened to or released from the sliding striker; and a sliding handle lever rod configured to be released from the sliding striker by applying tension to the sliding latch part upon the first operation.

14. The sliding/swing composite door of claim 12, further comprising:

a swing striker mounted on an inner surface of a vehicle body;

a swing latch part located on an inner surface of the swing door and configured to be fastened to or released from the swing striker; and a swing latch cable configured to be released from the swing striker by applying tension to the swing latch part upon the second operation.

15. The sliding/swing composite door of claim 12, wherein the sliding door further comprises a first fixing part on a back surface of the sliding door, wherein the first fixing part is configured to be connected to a swing handle lever rod located on one end of the outside handle to be rotatable.

16. A vehicle comprising:

a vehicle body;

a sliding door;

an outside handle located on an outer surface of the sliding door, wherein the sliding door is configured to be opened upon a first operation of the outside handle; and a swing door configured to be opened integrally with the sliding door upon a second operation of the outside handle, wherein the swing door is configured to be rotated and opened in a state where the sliding door is fully opened;

wherein the outside handle comprises:

a handle cover portion; and a body portion, wherein the body portion comprises:

a sliding body configured to be movable integrally with the handle cover portion in a sliding direction upon the first operation; and a swing body configured to be pulled integrally with the handle cover portion upon the second operation.

17. The vehicle of claim 16, further comprising:

a sliding striker mounted on an inner surface of the vehicle body;

a sliding latch part located on an inner surface of the sliding door and configured to be fastened to or released from the sliding striker;

a sliding handle lever rod configured to be released from the sliding striker by applying tension to the sliding latch part upon the first operation;

a swing striker mounted on the inner surface of the vehicle body;

a swing latch part located on an inner surface of the swing door and configured to be fastened to or released from the swing striker; and a swing latch cable configured to be released from the swing striker by applying tension to the swing latch part upon the second operation.

18. The vehicle of claim 16, wherein the sliding door further comprises:

a first fixing part on a back surface of the sliding door, wherein the first fixing part is configured to be connected to a swing handle lever rod located on one end of the outside handle to be rotatable; and a second fixing part formed to correspond to a location of the first fixing part at which the sliding door is fully opened and fastened to the first fixing part, wherein the second fixing part is configured to be integrally rotated by a rotation of the first fixing part upon the second operation, and wherein a swing latch cable connected to an upper end of the second fixing part is configured to apply tension to a swing latch part to be released from a swing striker.

19. The vehicle of claim 16, further comprising:

a first rail fixed to the vehicle body;

a first roller and a second roller located on an upper end of the sliding door and configured to be moved along the first rail in response to an operation of opening the sliding door;

an opening located on an edge of the first rail and formed to correspond to locations of the first roller and the second roller when the sliding door is fully opened a second rail fixed to a back surface of the swing door and located lower than the first rail; and a third roller and a fourth roller located on an intermediate end of the sliding door and configured to be moved along the second rail in response to the operation of opening the sliding door.

20. The vehicle of claim 16, further comprising:

a catch formed on one side end of the sliding door and configured to be rotated when in contact with one end of the swing door, wherein the catch comprises a locking protrusion on one end of the catch;

a catch pin formed on one edge of the swing door to correspond to a location of the catch, wherein if the sliding door is fully opened, the catch is configured to be rotated to be fitted into the catch pin; and a pawl adjacent to the catch, wherein the pawl comprises a locking projection on one end at a location corresponding to the locking protrusion, such that the locking protrusion and the locking projection are configured to be engaged with each other.

* * * * *